US008950180B2

(12) United States Patent
Ooki et al.

(10) Patent No.: US 8,950,180 B2
(45) Date of Patent: Feb. 10, 2015

(54) HYBRID CONSTRUCTION MACHINE

(75) Inventors: Takatoshi Ooki, Kasumigaura (JP); Yusuke Kajita, Ushiku (JP); Hidetoshi Satake, Ishioka (JP); Seiji Ishida, Hitachinaka (JP); Shiho Izumi, Hitachinaka (JP); Kouji Ishikawa, Kasumigaura (JP); Shinya Okumura, Kasumigaura (JP); Manabu Edamura, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 505 days.

(21) Appl. No.: 13/427,471

(22) Filed: Mar. 22, 2012

(65) Prior Publication Data

US 2012/0240581 A1 Sep. 27, 2012

(30) Foreign Application Priority Data

Mar. 25, 2011 (JP) ..... 2011-068629

(51) Int. Cl.
*E02F 9/12* (2006.01)
*E02F 9/20* (2006.01)
*E02F 9/22* (2006.01)

(52) U.S. Cl.
CPC ..... *E02F 9/123* (2013.01); *E02F 9/2095* (2013.01); *E02F 9/2217* (2013.01); *E02F 9/2296* (2013.01)
USPC ..... 60/414; 60/420

(58) Field of Classification Search
CPC ..... E02F 9/123; E02F 9/2217; E02F 9/2296; E02F 9/2095
USPC ..... 60/420, 414, 425, 468
See application file for complete search history.

(56) References Cited

U.S. PATENT DOCUMENTS 8,207,708 B2 * 6/2012 Morinaga et al. ..... 60/414
2008/0317574 A1 * 12/2008 Moriya et al. ..... 414/687

FOREIGN PATENT DOCUMENTS

JP 2004124381 A * 4/2004
JP 2005-290882 A 10/2005
JP 4024120 B2 10/2007
JP 2008-063888 A 3/2008

* cited by examiner

*Primary Examiner* — Thomas E Lazo
(74) *Attorney, Agent, or Firm* — Mattingly & Malur, PC

(57) ABSTRACT

A hybrid construction machine drives the upper swing structure using a hydraulic motor and an electric motor together and is capable of regenerating the energy of the upper swing structure in deceleration or stopping into electric power and using the regenerated electric power for assisting the hydraulic motor for driving the upper swing structure. The opening area characteristics of a meter-out restrictor and a bleed-off restrictor of a swing directional control valve are set to become larger than for construction machines driving the upper swing structure with the hydraulic motor alone. Torque of the electric motor is controlled so that the total sum of the actual torque occurring in the hydraulic and electric motors in deceleration or acceleration of the hydraulic motor equals the torque occurring when the opening area of the meter-out restrictor or the bleed-off restrictor is set at the prescribed opening area.

9 Claims, 15 Drawing Sheets

SIGNAL INCREASING CORRECTION PROCESS

SIGNAL DECREASING CORRECTION PROCESS

HYBRID CONSTRUCTION MACHINE

BACKGROUND OF THE INVENTION

1. Field of the Invention

The present invention relates to a hybrid construction machine, and in particular, to a hybrid construction machine whose upper swing structure is driven with a hydraulic motor and an electric motor.

2. Description of the Related Art

Hydraulic actuators have been used widely in the field of construction machines since devices in the construction machine can be implemented in small sizes and light weights relative to the outputs of the devices. In recent years, however, construction machines equipped with electric actuators for increasing the energy efficiency are being proposed and some of such construction machines are already in practical use today. Especially, a swing actuator for driving and swinging the upper swing structure of a construction machine with respect to the lower travel structure is a rotary actuator of a high inertial load that is used (started and stopped) frequently. Using an electric actuator as the swing actuator is highly advantageous for improving the energy efficiency since energy recovery (energy regeneration) can be expected when the upper swing structure is decelerated or stopped.

In the situation described above, construction machines driving the upper swing structure using a hydraulic motor and an electric motor together have become known as hydraulic construction machines capable of conducting the energy recovery with high efficiency, as described in Japanese Patent No. 4024120, JP,A 2005-290882 and JP,A 2008-63888.

SUMMARY OF THE INVENTION

By driving the upper swing structure using a hydraulic motor and an electric motor together as in the techniques described in Japanese Patent No. 4024120, JP,A 2005-290882 and JP,A 2008-63888, the energy of the upper swing structure in deceleration or stopping can be regenerated into electric power by the electric motor functioning as an electric generator and the energy efficiency can be improved.

However, the techniques described in Japanese Patent No. 4024120, JP,A 2005-290882 and JP,A 2008-63888 have focused exclusively on how to determine the torque of the electric motor in the driving (acceleration and deceleration (braking)) of the electric motor, without examining how to determine the balance (ratio) between the drive torque of the hydraulic motor and the drive torque of the electric motor. Consequently, operators familiar with conventional construction machines (driving the upper swing structure with the hydraulic actuator (hydraulic motor) alone) are necessitated to experience a feeling of strangeness since the operators cannot have an operational feeling equivalent to that in the conventional construction machines.

It is therefore the primary object of the present invention to provide a hybrid construction machine (construction machine driving the upper swing structure using a hydraulic motor and an electric motor together) capable of regenerating the energy of the upper swing structure in deceleration or stopping into electric power and using the regenerated electric power for assisting the hydraulic motor that drives the upper swing structure, while also being capable of securing a satisfactory operational feeling equivalent to that in construction machines driving the upper swing structure with the hydraulic motor alone.

(1) In order to achieve the above object, an aspect of the present invention provides a hybrid construction machine comprising: a lower travel structure; an upper swing structure which is mounted on the lower travel structure to be capable of swinging; a hydraulic circuit system which includes a swing hydraulic motor for driving and swinging the upper swing structure, a hydraulic pump supplying hydraulic fluid to the swing hydraulic motor, a tank receiving the hydraulic fluid returning from the swing hydraulic motor and serving as the source of supply of the hydraulic fluid to the hydraulic pump, and a directional control valve arranged in a line connecting the hydraulic pump and the swing hydraulic motor and controlling the direction and the flow rate of the hydraulic fluid discharged from the hydraulic pump and supplied to the swing hydraulic motor; a prime mover which drives the hydraulic pump; a swing electric motor which drives and swings the upper swing structure in an auxiliary manner, the swing electric motor functioning as an electric generator when the swinging of the upper swing structure is decelerating; an electricity storage device which receives and supplies electric energy from/to the swing electric motor; and a control device which controls the operation of the swing electric motor. The directional control valve includes a meter-in restrictor placed between the hydraulic pump and the swing hydraulic motor and a meter-out restrictor placed between the swing hydraulic motor and the tank. An opening area characteristic of the meter-out restrictor is set so that the opening area of the meter-out restrictor becomes larger than a prescribed opening area that is set to construction machines driving the upper swing structure with the swing hydraulic motor alone. The control device controls torque of the swing electric motor so that the total sum of actual braking torque occurring in the swing hydraulic motor and braking torque of the swing electric motor in deceleration of the swing hydraulic motor equals braking torque occurring when the opening area of the meter-out restrictor is set at the prescribed opening area.

In the hybrid construction machine configured as above, the upper swing structure is driven by using the swing hydraulic motor and the swing electric motor together. Therefore, the energy of the upper swing structure in deceleration or stopping can be regenerated into electric power and the regenerated electric power can be used for assisting the swing hydraulic motor that drives the upper swing structure. Further, the opening area characteristic of the meter-out restrictor is set so that the opening area of the meter-out restrictor becomes larger than the prescribed opening area set to the construction machines driving the upper swing structure with the swing hydraulic motor alone, and the torque of the swing electric motor is controlled so that the total sum of the actual braking torque occurring in the swing hydraulic motor and the braking torque of the swing electric motor in the deceleration of the swing hydraulic motor equals the braking torque occurring when the opening area of the meter-out restrictor is set at the prescribed opening area. Therefore, the braking torque in the deceleration of the swinging of the upper swing structure becomes equivalent to that in the construction machines driving the upper swing structure with the hydraulic motor alone. Consequently, a satisfactory operational feeling equivalent to that in the construction machines driving the upper swing structure with the hydraulic motor alone can be secured in the deceleration of the swinging of the upper swing structure.

(2) Preferably, in the hybrid construction machine (1), the opening area characteristic of the meter-out restrictor of the directional control valve is set so that the opening area of the meter-out restrictor considered in terms of an opening area characteristic with respect to the stroke of the directional control valve becomes larger than the prescribed opening area.

With the above configuration, just supplying an operating signal of a conventional operating device directly to the directional control valve makes the opening area of the meter-out restrictor of the directional control valve larger than the prescribed opening area. Therefore, an operation system including the conventional operating device can be employed without modification. Consequently, the operation system can be configured and implemented at a low cost.

(3) Preferably, in the hybrid construction machine (1), the opening area characteristic of the meter-out restrictor of the directional control valve is set so that the opening area of the meter-out restrictor considered in terms of an opening area characteristic with respect to the stroke of the directional control valve equals the prescribed opening area. The hybrid construction machine further comprises an operating device which outputs an operating signal for driving the directional control valve. The control device corrects the operating signal so that the opening area of the meter-out restrictor considered in terms of an opening area characteristic of the directional control valve with respect to the operating signal becomes larger than the prescribed opening area.

With the above configuration, even when the directional control valve is identical with that in the construction machines driving the upper swing structure with the swing hydraulic motor alone, the opening area of the meter-out restrictor considered in terms of the opening area characteristic with respect to the operating signal becomes larger than the prescribed opening area. Therefore, the conventional directional control valve can be employed without modification. Consequently, the directional control valve can be configured and implemented at a low cost.

(4) Preferably, in the hybrid construction machine (1), the directional control valve further includes a bleed-off restrictor placed between the hydraulic pump and the tank. An opening area characteristic of the bleed-off restrictor is set so that the opening area of the bleed-off restrictor becomes larger than a prescribed opening area that is set to the construction machines driving the upper swing structure with the swing hydraulic motor alone. The control device controls the torque of the swing electric motor so that the total sum of actual acceleration torque occurring in the swing hydraulic motor and acceleration torque of the swing electric motor in acceleration of the swing hydraulic motor equals acceleration torque occurring when the opening area of the bleed-off restrictor is set at the prescribed opening area.

With the above configuration, the acceleration torque in the acceleration of the swinging of the upper swing structure becomes equivalent to that in the construction machines driving the upper swing structure with the hydraulic motor alone. Consequently, a satisfactory operational feeling equivalent to that in the construction machines driving the upper swing structure with the hydraulic motor alone can be secured in the acceleration of the swinging of the upper swing structure.

(5) Preferably, in the hybrid construction machine (4), the opening area characteristic of the bleed-off restrictor of the directional control valve is set so that the opening area of the bleed-off restrictor considered in terms of an opening area characteristic with respect to the stroke of the directional control valve becomes larger than the prescribed opening area.

With the above configuration, just supplying an operating signal of a conventional operating device directly to the directional control valve makes the opening area of the bleed-off restrictor of the directional control valve larger than the prescribed opening area. Therefore, an operation system including the conventional operating device can be employed without modification. Consequently, the operation system can be configured and implemented at a low cost.

(6) Preferably, in the hybrid construction machine (4), the opening area characteristic of the bleed-off restrictor of the directional control valve is set so that the opening area of the bleed-off restrictor considered in terms of an opening area characteristic with respect to the stroke of the directional control valve equals the prescribed opening area. The hybrid construction machine further comprises an operating device which outputs an operating signal for driving the directional control valve. The control device corrects the operating signal so that the opening area of the bleed-off restrictor considered in terms of an opening area characteristic of the directional control valve with respect to the operating signal becomes larger than the prescribed opening area.

With the above configuration, even when the directional control valve is identical with that in the construction machines driving the upper swing structure with the swing hydraulic motor alone, the opening area of the bleed-off restrictor considered in terms of the opening area characteristic with respect to the operating signal becomes larger than the prescribed opening area. Therefore, the conventional directional control valve can be employed without modification. Consequently, the directional control valve can be configured and implemented at a low cost.

(7) In order to achieve the above object, another aspect of the present invention provides a hybrid construction machine comprising: a lower travel structure; an upper swing structure which is mounted on the lower travel structure to be capable of swinging; a swing hydraulic motor which drives and swings the upper swing structure; a hydraulic pump which supplies hydraulic fluid to the swing hydraulic motor; a tank which receives the hydraulic fluid returning from the swing hydraulic motor and serves as the source of supply of the hydraulic fluid to the hydraulic pump; a directional control valve which is arranged in a line connecting the hydraulic pump and the swing hydraulic motor and controls the direction and the flow rate of the hydraulic fluid discharged from the hydraulic pump and supplied to the swing hydraulic motor; a prime mover which drives the hydraulic pump; a swing electric motor which drives and swings the upper swing structure in an auxiliary manner, the swing electric motor functioning as an electric generator when the swinging of the upper swing structure is decelerating; an electricity storage device which receives and supplies electric energy from/to the swing electric motor; and a control device which controls the operation of the swing electric motor. The directional control valve includes a bleed-off restrictor placed between the hydraulic pump and the tank, a meter-in restrictor placed between the hydraulic pump and the swing hydraulic motor, and a meter-out restrictor placed between the swing hydraulic motor and the tank. An opening area characteristic of the bleed-off restrictor is set so that the opening area of the bleed-off restrictor becomes larger than a prescribed opening area that is set to construction machines driving the upper swing structure with the swing hydraulic motor alone. The control device controls torque of the swing electric motor so that the total sum of actual acceleration torque occurring in the swing hydraulic motor and acceleration torque of the swing electric motor in acceleration of the swing hydraulic motor equals acceleration torque occurring when the opening area of the bleed-off restrictor is set at the prescribed opening area.

In the hybrid construction machine configured as above, the upper swing structure is driven by using the swing hydraulic motor and the swing electric motor together. Therefore, the energy of the upper swing structure in deceleration or stopping can be regenerated into electric power and the regenerated electric power can be used for assisting the swing hydraulic motor that drives the upper swing structure. Further, the opening area characteristic of the bleed-off restrictor is set so that the opening area of the bleed-off restrictor becomes larger than the prescribed opening area set to the construction machines driving the upper swing structure with the swing hydraulic motor alone, and the torque of the swing electric motor is controlled so that the total sum of the actual acceleration torque occurring in the swing hydraulic motor and the acceleration torque of the swing electric motor in the acceleration of the swing hydraulic motor equals the acceleration torque occurring when the opening area of the bleed-off restrictor is set at the prescribed opening area. Therefore, the acceleration torque in the acceleration of the swinging of the upper swing structure becomes equivalent to that in the construction machines driving the upper swing structure with the hydraulic motor alone. Consequently, a satisfactory operational feeling equivalent to that in the construction machines driving the upper swing structure with the hydraulic motor alone can be secured in the acceleration of the swinging of the upper swing structure.

(8) Preferably, in the hybrid construction machine (7), the opening area characteristic of the bleed-off restrictor of the directional control valve is set so that the opening area of the bleed-off restrictor considered in terms of an opening area characteristic with respect to the stroke of the directional control valve becomes larger than the prescribed opening area.

With the above configuration, just supplying an operating signal of a conventional operating device directly to the directional control valve makes the opening area of the bleed-off restrictor of the directional control valve larger than the prescribed opening area. Therefore, an operation system including the conventional operating device can be employed without modification. Consequently, the operation system can be configured and implemented at a low cost.

(9) Preferably, in the hybrid construction machine (7), the opening area characteristic of the bleed-off restrictor of the directional control valve is set so that the opening area of the bleed-off restrictor considered in terms of an opening area characteristic with respect to the stroke of the directional control valve equals the prescribed opening area. The hybrid construction machine further comprises an operating device which outputs an operating signal for driving the directional control valve. The control device corrects the operating signal so that the opening area of the bleed-off restrictor considered in terms of an opening area characteristic of the directional control valve with respect to the operating signal becomes larger than the prescribed opening area.

With the above configuration, even when the directional control valve is identical with that in the construction machines driving the upper swing structure with the swing hydraulic motor alone, the opening area of the bleed-off restrictor considered in terms of the opening area characteristic with respect to the operating signal becomes larger than the prescribed opening area. Therefore, the conventional directional control valve can be employed without modification. Consequently, the directional control valve can be configured and implemented at a low cost.

According to the present invention, in construction machines driving the upper swing structure by using a swing hydraulic motor and a swing electric motor together, the energy of the upper swing structure in deceleration or stopping can be regenerated into electric power and the regenerated electric power can be used for assisting the swing hydraulic motor that drives the upper swing structure, while also securing a satisfactory operational feeling equivalent to that in the construction machines driving the upper swing structure with the hydraulic motor alone.

DESCRIPTION OF THE PREFERRED EMBODIMENTS

Figure 1:
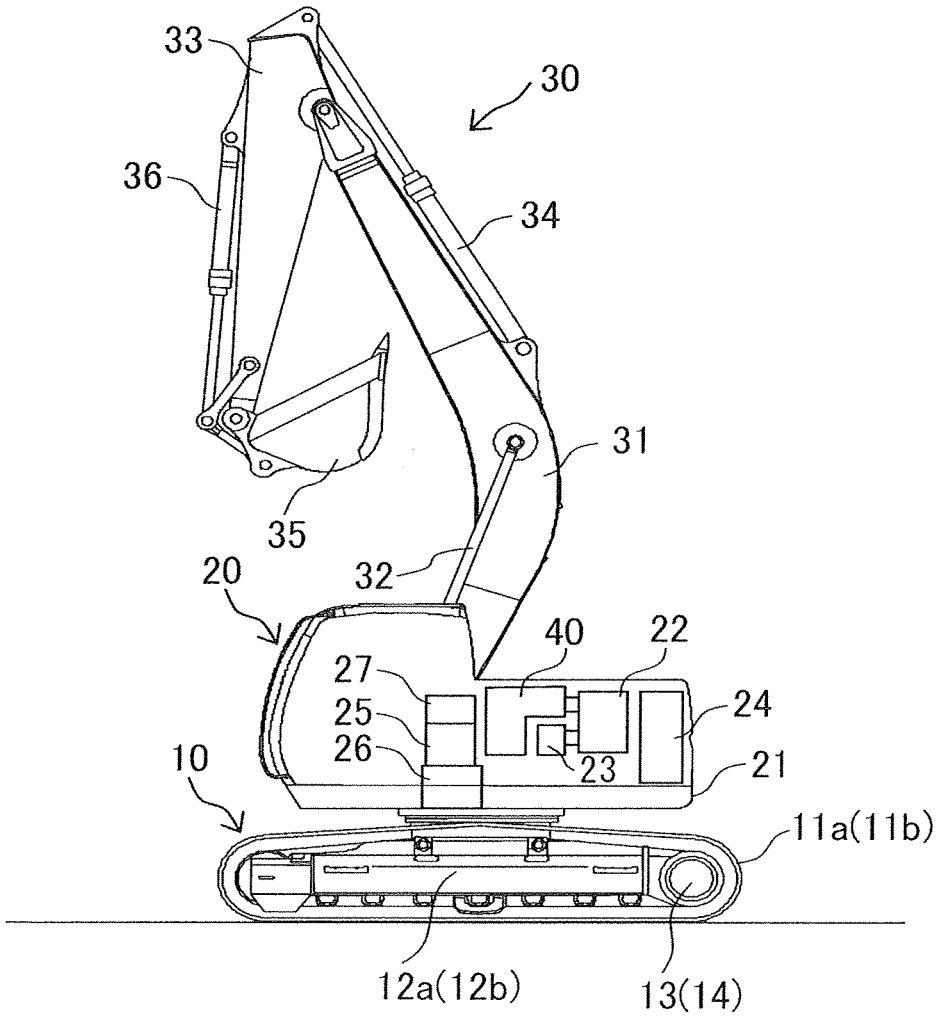
FIG. 1 is a side view of a hybrid hydraulic shovel in accordance with a first embodiment of the present invention.

Referring now to the drawings, a description will be given in detail of preferred embodiments in accordance with the present invention.

The following explanation of the embodiments will be given by taking hydraulic shovels as examples of construction machines. The present invention is applicable to a wide variety of construction machines (e.g., operating machines) having a swing structure and thus the application of the present invention is not restricted to hydraulic shovels. For example, the present invention is applicable also to various other construction machines such as crane vehicles having a swing structure.

First Embodiment

<Configuration of Hydraulic Shovel>

FIG. 1 is a side view of a hybrid hydraulic shovel in accordance with a first embodiment of the present invention.

Referring to FIG. 1, the hybrid hydraulic shovel comprises a lower travel structure 10, an upper swing structure 20 and a shovel mechanism 30. The upper swing structure 20 is mounted on the lower travel structure 10 to be capable of swinging.

The lower travel structure 10 includes a pair of crawlers 11*a* and 11*b* (only one side is shown in FIG. 1), a pair of crawler frames 12*a* and 12*b*, a pair of traveling hydraulic motors 13 and 14 (left traveling hydraulic motor 13, right traveling hydraulic motor 14) for independently driving and controlling the crawlers 11*a* and 11*b*, respectively, deceleration mechanisms for the hydraulic motors 13 and 14, etc.

The upper swing structure 20 includes a swinging frame 21, an engine 22 (as a prime mover) mounted on the swinging frame 21, an electric generator 23 driven by the engine 22, a battery 24 for storing electric power generated by the electric generator 23, a swing electric motor 25 driven by the electric power from the electric generator 23 or the battery 24, and a swinging mechanism 26, etc. The swinging mechanism 26, including a swing hydraulic motor 27, drives and swings the upper swing structure 20 (swinging frame 21) with respect to the lower travel structure 10 using driving force of the swing hydraulic motor 27 and swing electric motor 25. The upper swing structure 20 is driven mainly by the swing hydraulic motor 27 and auxiliarily (in an auxiliary manner) by the swing electric motor 25 conducting the driving in cooperation with the swing hydraulic motor 27.

The shovel mechanism 30 includes a boom 31, a boom cylinder 32 for driving the boom 31, an arm 33 supported by a distal end part of the boom 31 to be rotatable around an axis, an arm cylinder 34 for driving the arm 33, a bucket 35 supported by the distal end of the arm 33 to be rotatable around an axis, a bucket cylinder 36 for driving the bucket 35, etc.

Further, a hydraulic circuit system 40 for driving hydraulic actuators (such as the aforementioned traveling hydraulic motors 13 and 14, swing hydraulic motor 27, boom cylinder 32, arm cylinder 34 and bucket cylinder 36) is mounted on the swinging frame 21 of the upper swing structure 20. The hydraulic circuit system 40 includes a hydraulic pump 41 (see FIG. 2) as a hydraulic pressure source for generating the hydraulic pressure and a control valve unit 42 (see FIG. 2) for driving and controlling the actuators. The hydraulic pump 41 is driven by the engine 22.

<System Configuration>

Figure 2:
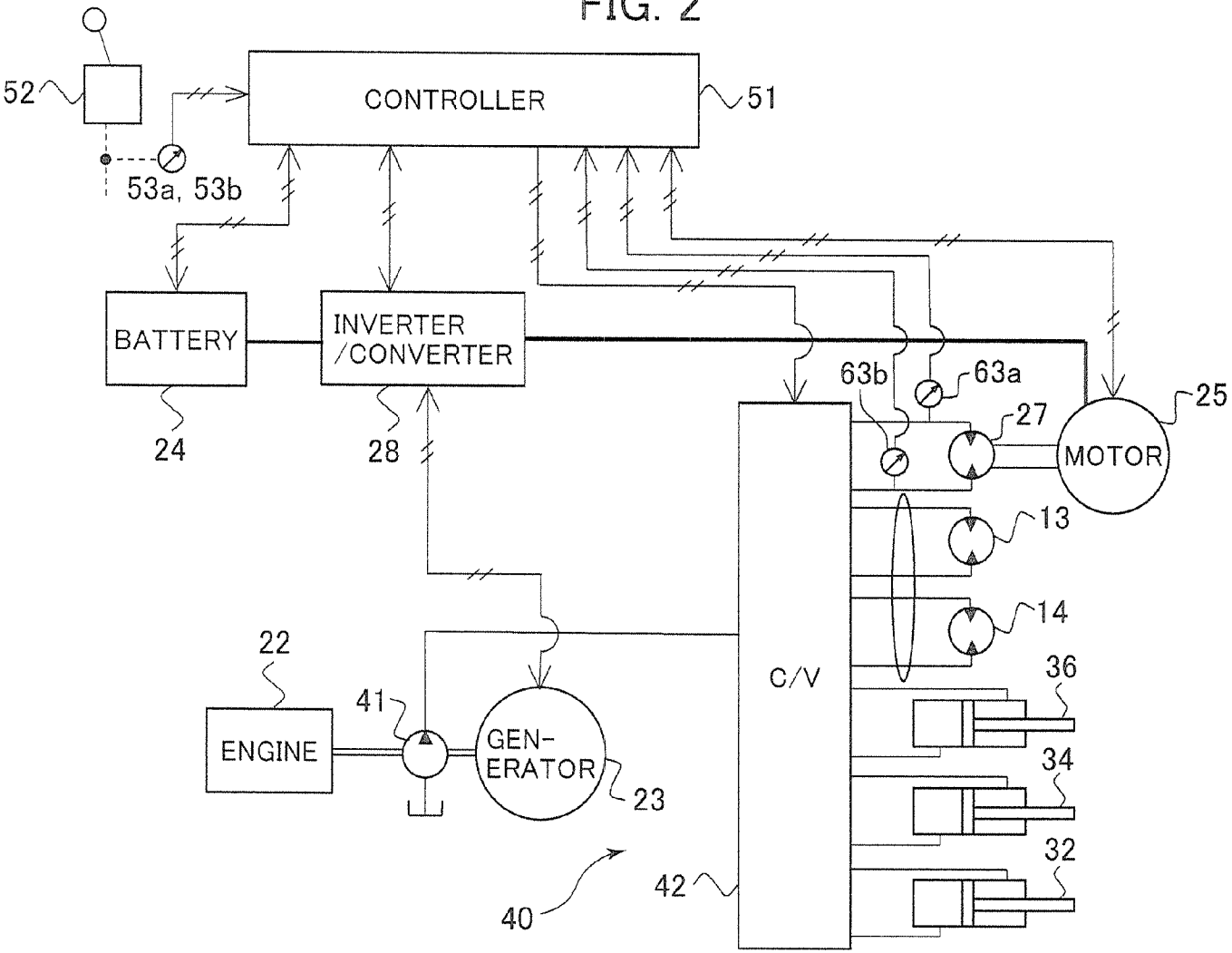
FIG. 2 is a schematic block diagram showing the system configuration of principal electric/hydraulic devices of the hydraulic shovel.

FIG. 2 shows the system configuration of principal electric/hydraulic devices of the hydraulic shovel, wherein components identical with those in FIG. 1 are assigned the same reference characters as in FIG. 1. In FIG. 2, double-lined lines (lines with two obliquely crossing line segments) represent a mechanical driving system, thick solid lines represent an electric driving system, and solid lines of normal thickness represent a hydraulic driving system. As shown in FIG. 2, the driving force of the engine 22 is transmitted to the hydraulic pump 41. The control valve unit 42 includes directional control valves (including valve components called spools) for the actuators, respectively. The directions and flow rates of the hydraulic fluid supplied to the swing hydraulic motor 27, the boom cylinder 32, the arm cylinder 34, the bucket cylinder 36 and the traveling hydraulic motors 13 and 14 are controlled by driving the directional control valves according to operating signals (operation command pressures) inputted from a lever-operated swinging operating device 52 (with a lever for controlling the swinging of the upper swing structure 20) and other lever-operated operating devices (unshown).

DC electric power from the battery 24 is converted by an inverter/converter 28 into a pulse signal at a prescribed voltage and a prescribed frequency and inputted to the swing electric motor 25. The swing electric motor 25 in deceleration is used in its electric generator property. The inverter/converter 28 converts the electric power regenerated by the swing electric motor 25 into DC electric power and stores the electric power in the battery 24.

The inverter/converter 28 controls the revolution speed and the torque of the swing electric motor 25 according to a signal from a controller 51. The controller 51 calculates and outputs the signals to be sent to the inverter/converter 28 and the control valve unit 42 based on detection signals inputted from pressure sensors 53*a* and 53*b* for detecting the operating signals (operation command pressures) from the swinging operating device 52 and pressure sensors 63*a* and 63*b* for detecting meter-in pressure and meter-out pressure of the swing hydraulic motor 27.

<Swing Hydraulic System>

Figure 3:
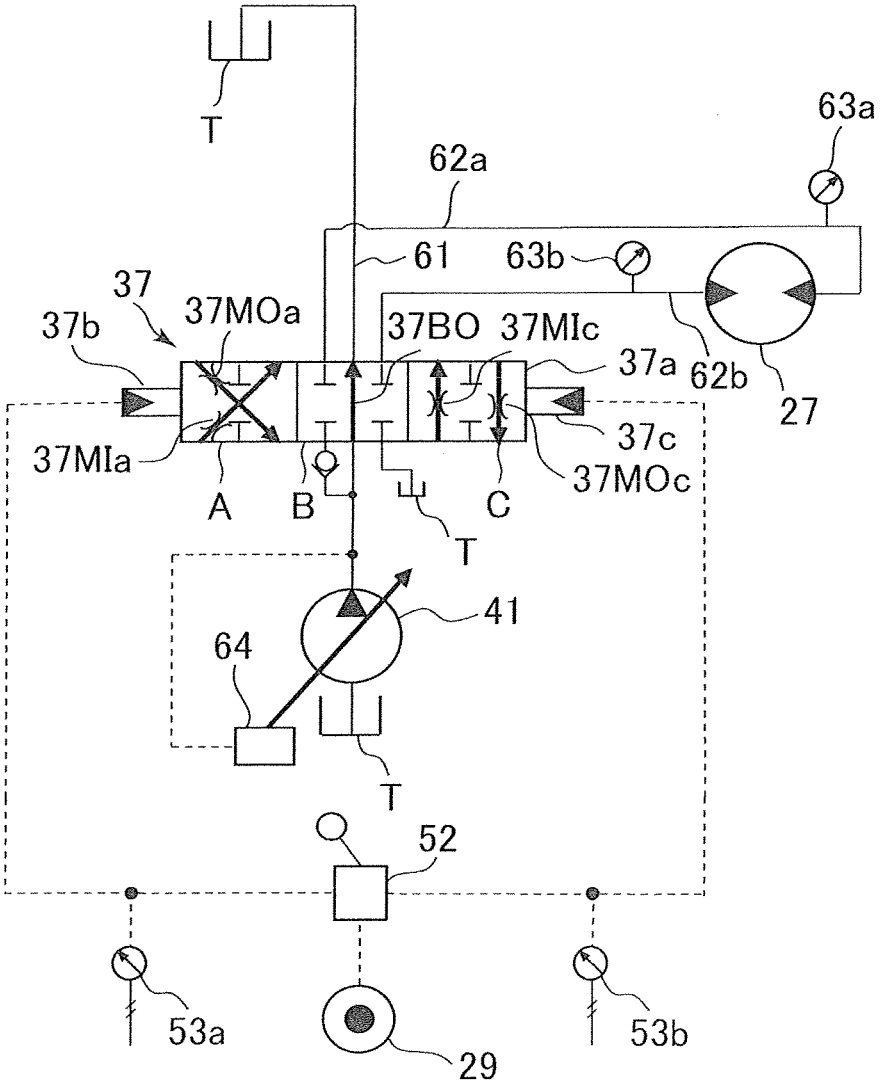
FIG. 3 is a schematic diagram showing the details of a part of a hydraulic circuit system related to a swing section (swing hydraulic system)

FIG. 3 shows the details of a part of the hydraulic circuit system 40 related to the swing section (hereinafter referred to as a "swing hydraulic system"), wherein components identical with those in FIG. 1 or FIG. 2 are assigned the same reference characters as in FIG. 1 or FIG. 2.

Referring to FIG. 3, the swing hydraulic system includes the aforementioned hydraulic pump 41 and swing hydraulic motor 27, a swing directional control valve 37, and a tank T. The swing directional control valve 37 is arranged in a line connecting the hydraulic pump 41 and the swing hydraulic motor 27 in order to control the direction and the flow rate of the hydraulic fluid discharged from the hydraulic pump 41 and supplied to the swing hydraulic motor 27. The swing directional control valve 37 (a valve of the open center type) is arranged in an open center hydraulic line 61 having an upstream end connected to the hydraulic pump 41 and a downstream end connected to the tank T. In the swing directional control valve 37, the area of the opening (opening area) of each restrictor (explained later) is uniquely determined by the position of a spool 37*a* which moves according to the operating signal from the swinging operating device 52. The other directional control valves also operate in similar ways. The tank T receives the hydraulic fluid returning from the swing hydraulic motor 27 and other actuators, while also serving as the source of supply of the hydraulic fluid to the hydraulic pump 41.

The hydraulic pump 41 is a variable displacement pump equipped with a regulator 64 for executing the torque control. By operating the regulator 64, the tilting angle of the hydraulic pump 41 is changed, the displacement of the hydraulic pump 41 is changed, and consequently, the discharge flow rate of the hydraulic pump 41 is changed.

The swinging operating device 52 (hereinafter referred to simply as an "operating device 52") includes a pressure-reducing valve which reduces the pressure from a pilot hydraulic pressure source 29 according to the operation amount of the lever. The operating device 52 supplies an operation command pressure corresponding to the operation amount of the lever to a left pressure chamber 37*b* or a right pressure chamber 37*c* of the swing directional control valve 37 as the operating signal.

The swing directional control valve 37 has three positions A, B and C. By receiving the operating signal (operation command pressure) from the operating device 52, the swing directional control valve 37 is continuously switched from the position B (neutral position) to the position A or the position C. The swing directional control valve 37 includes a bleed-off restrictor 37BO situated on the open center hydraulic line 61 (and thus situated between the hydraulic pump 41 and the tank T), meter-in restrictors 37MIa and 37MIc situated between the hydraulic pump 41 and the swing hydraulic motor 27, and meter-out restrictors 37MOa and 37MOc situated between the swing hydraulic motor 27 and the tank T. The downstream end of the bleed-off restrictor 37BO is connected to the tank T via the open center hydraulic line 61. The downstream ends of the meter-in restrictors 37MIa and 37MIc and the upstream ends of the meter-out restrictors 37MOa and 37MOc are connected to input/output ports of the swing hydraulic motor 27 via actuator lines 62*a* and 62*b*. The actuator lines 62*a* and 62*b* are equipped with pressure sensors 63*a* and 63*b*, respectively. Detection signals outputted by the pressure sensors 63*a* and 63*b* are sent to the controller 51 (see FIG. 2).

When the swing directional control valve 37 is at the neutral position B, the hydraulic fluid discharged from the hydraulic pump 41 flows through the bleed-off restrictor 37BO and returns to the tank T via the open center hydraulic line 61. When the swing directional control valve 37 receiving the operation command pressure corresponding to the lever operation amount of the operating device 52 is switched to the position A, the hydraulic fluid from the hydraulic pump 41 is supplied to one port of the swing hydraulic motor 27 via the meter-in restrictor 37MIa at the position A, and returning hydraulic fluid from the swing hydraulic motor 27 returns to the tank T via the meter-out restrictor 37MOa at the position A. By the movement of the hydraulic fluid, the swing hydraulic motor 27 is rotated in one direction. In contrast, when the swing directional control valve 37 receiving the operation command pressure corresponding to the lever operation amount of the operating device 52 is switched to the position C, the hydraulic fluid from the hydraulic pump 41 is supplied to the other port of the swing hydraulic motor 27 via the meter-in restrictor 37MIc at the position C, and returning hydraulic fluid from the swing hydraulic motor 27 returns to the tank T via the meter-out restrictor 37MOc at the position C. By the movement of the hydraulic fluid, the swing hydraulic motor 27 is rotated in the reverse direction compared to the case of the position A.

When the swing directional control valve 37 is situated at an intermediate position between the neutral position B and the position A, the hydraulic fluid from the hydraulic pump 41 is distributed to the bleed-off restrictor 37BO and the meter-in restrictor 37MIa. In this case, a pressure corresponding to the opening area of the bleed-off restrictor 37BO develops on the inlet side of the meter-in restrictor 37MIa, by which the hydraulic fluid is supplied to the swing hydraulic motor 27 and drive torque (acceleration torque) corresponding to the pressure (i.e., corresponding to the opening area of the bleed-off restrictor 37BO) is given to the swing hydraulic motor 27. Meanwhile, the hydraulic fluid discharged from the swing hydraulic motor 27 receives resistance corresponding to the opening area of the meter-out restrictor 37MOa at that time (back pressure), causing braking torque corresponding to the opening area of the meter-out restrictor 37MOa. Operation when the swing directional control valve 37 is situated at an intermediate position between the neutral position B and the position C is similar to the above operation, and thus repeated explanation thereof is omitted for brevity.

<Opening Area Characteristic>

Figure 4:
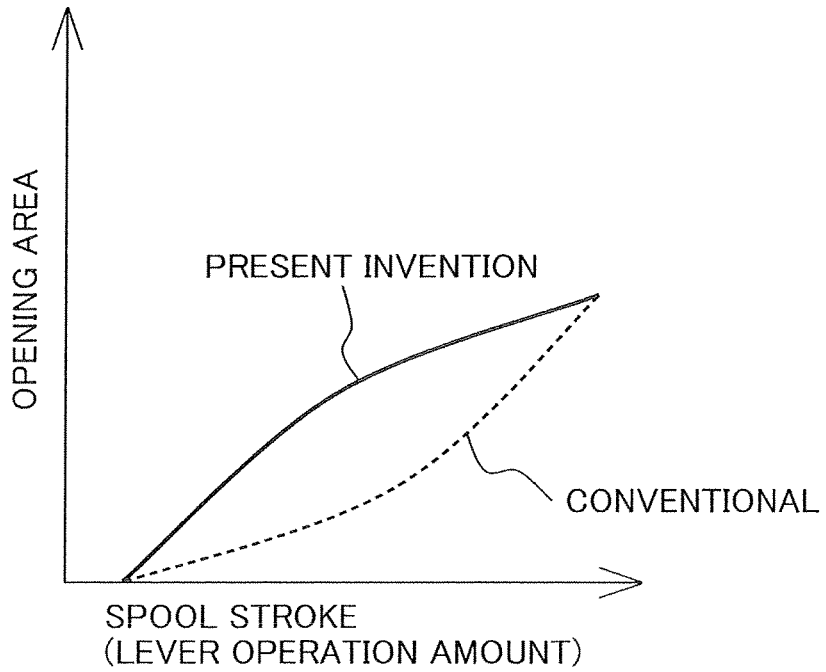
FIG. 4 is a graph showing an opening area characteristic of a meter-out restrictor of a swing directional control valve with respect to a spool stroke.

FIG. 4 shows an opening area characteristic of the meter-out restrictor of the swing directional control valve 37 with respect to the spool stroke. In FIG. 4, the solid line represents an opening area characteristic of the meter-out restrictor (37MOa, 37MOc) of the swing directional control valve 37 in this embodiment, while the broken line represents an opening area characteristic of a meter-out restrictor of a swing directional control valve capable of securing satisfactory operability in a conventional hydraulic shovel (employing no electric motor for the swinging) by the hydraulic solo driving. As shown in FIG. 4, the meter-out restrictor (37MOa, 37MOc) of the swing directional control valve 37 in this embodiment is designed so that the opening areas at the starting point and the end point of the control zone coincide with those in the conventional hydraulic shovel but the opening areas in the intermediate zone (between the starting point and the end point) are larger than those in the conventional hydraulic shovel. Thus, the opening area characteristic of the meter-out restrictor (37MOa, 37MOc) of the swing directional control valve 37 is set so that the opening area is larger than the opening area prescribed for the conventional construction machine (hydraulic shovel) which drives the upper swing structure 20 with the swing hydraulic motor 27 alone (broken line in FIG. 4).

Figure 5:
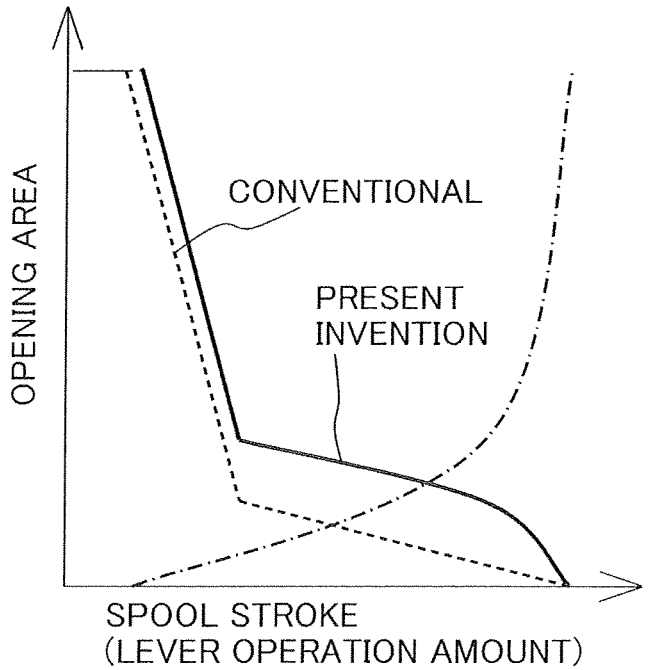
FIG. 5 is a graph showing opening area characteristics of a meter-in restrictor and a bleed-off restrictor of the swing directional control valve with respect to the spool stroke.

FIG. 5 shows opening area characteristics of the meter-in restrictor and the bleed-off restrictor of the swing directional control valve 37 with respect to the spool stroke. In FIG. 5, the solid line represents an opening area characteristic of the bleed-off restrictor 37BO of the swing directional control valve 37 in this embodiment, while the broken line represents an opening area characteristic of a bleed-off restrictor of a swing directional control valve capable of securing satisfactory operability in the conventional hydraulic shovel (employing no electric motor for the swinging) by the hydraulic solo driving. A chain line represents an opening area characteristic of the meter-in restrictor (37MIa, 37MIc) of the swing directional control valve 37 in this embodiment, which is identical with that in the conventional hydraulic shovel. As shown in FIG. 5, the bleed-off restrictor 37BO of the swing directional control valve 37 in this embodiment is designed so that the opening areas at the starting point and the end point of the control zone coincide with those in the conventional hydraulic shovel but the opening areas in the intermediate zone are larger than those in the conventional hydraulic shovel. Thus, the opening area characteristic of the bleed-off restrictor 37BO of the swing directional control valve 37 is set so that the opening area is larger than the opening area prescribed for the conventional construction machine (hydraulic shovel) which drives the upper swing structure 20 with the swing hydraulic motor 27 alone (broken line in FIG. 5). The opening area characteristic of the meter-in restrictor in this embodiment is set to be identical with that in the conventional hydraulic shovel.

<Control Principles>

Next, processing functions of the controller 51 will be described below.

First, control principles of the controller 51 will be explained.

As explained above, the opening area characteristic of the meter-out restrictor of the swing directional control valve 37 in this embodiment is set so that the opening area of the meter-out restrictor is larger than the prescribed opening area in the construction machine (hydraulic shovel) driving the upper swing structure 20 with the swing hydraulic motor 27 alone. Therefore, when the upper swing structure 20 is driven with the swing hydraulic motor 27 alone, the braking torque in this embodiment decreases (becomes lower) compared to the braking torque in the conventional hydraulic shovel driving the upper swing structure 20 with the swing hydraulic motor 27 alone.

Further, the opening area characteristic of the bleed-off restrictor of the swing directional control valve 37 in this embodiment is set so that the opening area of the bleed-off restrictor is larger than the prescribed opening area in the conventional construction machine (hydraulic shovel) driving the upper swing structure 20 with the swing hydraulic motor 27 alone as explained above. Therefore, when the upper swing structure 20 is driven with the swing hydraulic motor 27 alone, the acceleration torque in this embodiment decreases compared to the acceleration torque in the conventional hydraulic shovel driving the upper swing structure 20 with the swing hydraulic motor 27 alone.

Therefore, by executing control in the deceleration of the swing hydraulic motor 27 so as to compensate for the decrease in the braking torque of the swing hydraulic motor 27 (corresponding to the increase in the opening area of the meter-out restrictor) with the output torque of the swing electric motor 25, the total sum of the actual braking torque occurring in the swing hydraulic motor 27 and the braking torque of the swing electric motor 25 becomes equal to the braking torque in the conventional hydraulic shovel which drives the upper swing structure 20 with the swing hydraulic motor 27 alone (braking torque occurring when the opening area of the meter-out restrictor is set at the prescribed opening area of the directional control valve 37 in the construction machines driving the upper swing structure 20 with the swing hydraulic motor 27 alone).

Similarly, by executing control in the acceleration of the swing hydraulic motor 27 so as to compensate for the decrease in the acceleration torque of the swing hydraulic motor 27 (corresponding to the increase in the opening area of the bleed-off restrictor) with the output torque of the swing electric motor 25, the total sum of the actual acceleration torque occurring in the swing hydraulic motor 27 and the acceleration torque of the swing electric motor 25 becomes equal to the acceleration torque in the conventional hydraulic shovel which drives the upper swing structure 20 with the swing hydraulic motor 27 alone (acceleration torque occurring when the opening area of the bleed-off restrictor is set at the prescribed opening area of the directional control valve 37 in the construction machines driving the upper swing structure 20 with the swing hydraulic motor 27 alone).

The controller 51 controls the output torque of the swing electric motor 25 based on the above ideas.

An example of the control method will be described below.

Figure 6:
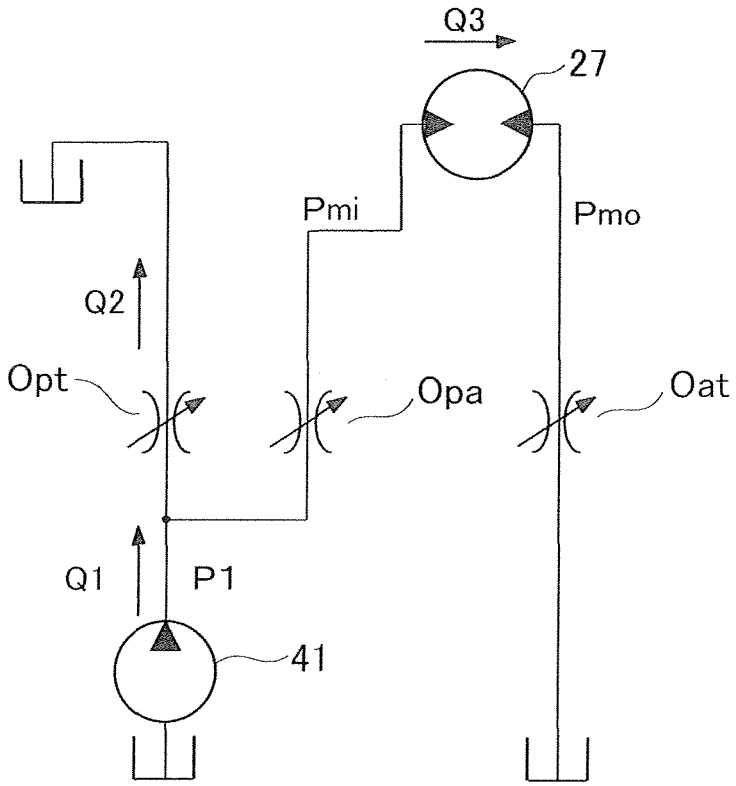
FIG. 6 is a diagram schematically showing the swing hydraulic system shown in FIG. 3.

FIG. 6 is a diagram schematically showing the swing hydraulic system shown in FIG. 3, wherein the reference character "Opt" represents the bleed-off restrictor 37BO, "Opa" represents the meter-in restrictor (37Mla, 37MIc), and "Oat" represents the meter-out restrictor (37MOa, 37MOc).

The opening area of the meter-out restrictor capable of securing satisfactory operability in the conventional hydraulic shovel by the hydraulic solo driving (broken line in FIG. 4) is expressed as "Aat0". The opening area of the bleed-off restrictor (bleed-off opening area) capable of securing satisfactory operability in the conventional hydraulic shovel by the hydraulic solo driving (broken line in FIG. 5) is expressed as "Apt0". The opening area of the meter-in restrictor capable of securing satisfactory operability in the conventional hydraulic shovel by the hydraulic solo driving (chain line in FIG. 5) is expressed as "Apc". Similarly, the opening area of the meter-out restrictor Oat of the swing directional control valve 37 in this embodiment is expressed as "Aat" and the opening area of the bleed-off restrictor Opt in this embodiment is expressed as "Apt". In this case, relationships Aat>Aat0 and Apt>Apt0 hold as mentioned above. The opening area of the meter-in restrictor Opa of the swing directional control valve 37 in this embodiment equals that (Apc) in the conventional hydraulic shovel.

(a) A meter-out pressure Pmo0 (discharge pressure on the outlet side of the swing hydraulic motor 27), in a case where the swing hydraulic motor 27 is controlled by employing the opening area Aat0 of the meter-out restrictor capable of securing satisfactory operability in the conventional hydraulic shovel by the hydraulic solo driving, is determined as below.

The flow rate of the hydraulic fluid flowing through the meter-out restrictor, determined from the displacement volume and the revolution speed of the swing hydraulic motor 27, is expressed as "Q3". An equation regarding an orifice is generally expressed as follows:

$$Q=CA\sqrt{(\Delta P)} \quad (1)$$

where "Q" denotes the flow rate through the orifice, "C" denotes a flow rate coefficient, "A" denotes the opening area of the orifice, and "ΔP" denotes differential pressure across the orifice. Differential pressure (APat) across the meter-out restrictor (opening area: Aat0) can be determined by substituting the opening area Aat0 and the flow rate Q3 into the orifice equation (1). In this case, the meter-out pressure Pmo0 (in the case of employing the meter-out opening area Aat0 capable of securing satisfactory operability in the conventional hydraulic shovel by the hydraulic solo driving) can be derived by assuming that the pressure downstream of the meter-out restrictor is constant at the tank pressure.

(b) A meter-in pressure Pmi0 (supply pressure on the inlet side of the swing hydraulic motor 27), in a case where the swing hydraulic motor 27 is controlled by employing the opening area Apt0 of the bleed-off restrictor and the opening area Apc of the meter-in restrictor capable of securing satisfactory operability in the conventional hydraulic shovel by the hydraulic solo driving, is determined as below.

First, discharge pressure P1 of the hydraulic pump 41 is determined as below. The flow rate Q3 through the swing hydraulic motor 27 has already been acquired. A discharge flow rate Q1 of the hydraulic pump 41 can be determined from the lever operation amount of the operating device 52 (operating signal) and characteristics of the regulator 64 of the hydraulic pump 41. A flow rate Q2 through the bleed-off restrictor Opt can be determined by substituting the flow rate Q3 through the swing hydraulic motor 27 and the pump discharge flow rate Q1 into the following expression (2):

$$Q2=Q1-Q3 \quad (2)$$

Differential pressure (ΔPpt) across the bleed-off restrictor (opening area: Apt0) can be determined by substituting the flow rate Q2 and the opening area Apt0 of the bleed-off restrictor (capable of securing satisfactory operability in the conventional hydraulic shovel by the hydraulic solo driving) into the orifice equation (1). In this case, the pump discharge pressure P1 can be derived by assuming that the pressure downstream of the bleed-off restrictor is constant at the tank pressure.

Subsequently, since the flow rate through the meter-in restrictor equals the flow rate Q3 through the swing hydraulic motor 27, the meter-in pressure Pmi0 (in the case of employing the opening area Apt0 of the meter-in restrictor capable of securing satisfactory operability in the conventional hydraulic shovel by the hydraulic solo driving) can be derived by substituting the flow rate Q3 through the meter-in restrictor, the pump discharge pressure P1 and the meter-in opening area Apc into the orifice equation (1).

(c) By using the meter-out pressure Pmo0 and the meter-in pressure Pmi0 derived as above, swinging hydraulic torque Tid1, in a case where the swing directional control valve has the opening areas capable of securing satisfactory operability in the conventional hydraulic shovel by the hydraulic solo driving, is determined from the following expression (3):

$$Tid1=\eta q(Pmi0-Pmo0) \quad (3)$$

(d) Meanwhile, swinging hydraulic torque Tre1 of the swing hydraulic system in this embodiment shown in FIG. 6 is determined from the following expression (4) by using meter-in pressure Pmi and meter-out pressure Pmo actually measured:

$$Tre1=\eta q(Pmi-Pmo) \quad (4)$$

(e) In order to achieve swinging torque equivalent to the swinging hydraulic torque of the case where the swing directional control valve in the conventional hydraulic shovel has the opening areas capable of securing satisfactory operability by the hydraulic solo driving, the difference between the swinging hydraulic torque Tid1 determined from the expression (3) and the swinging hydraulic torque Tre1 determined from the expression (4) should be given as the output torque of the swing electric motor 25 as indicated by the following expression:

$$Tmot=Tid1-Tre1 \quad (5)$$

<Processing Functions of Controller>

Figure 7:
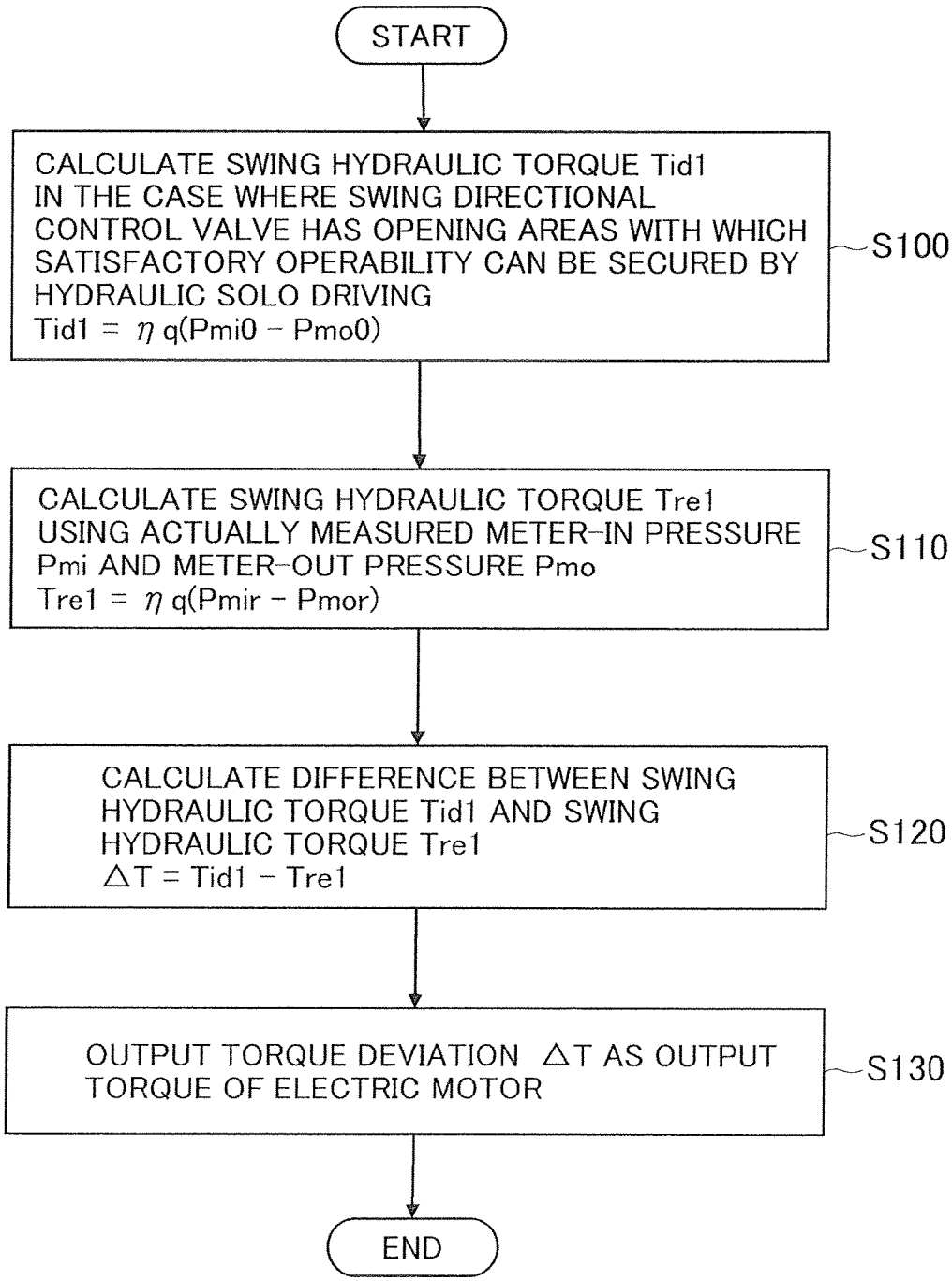
FIG. 7 is a flow chart showing processing functions of a controller.

Next, the processing functions of the controller 51 executing the above control will be described referring to FIG. 7. FIG. 7 is a flow chart showing the processing functions of the controller 51.

In the controller 51, the characteristic of the opening area Aat0 of the meter-out restrictor (broken line in FIG. 4), the characteristic of the bleed-off opening area Apt0 (broken line in FIG. 5) and the characteristic of the opening area Apc of the meter-in restrictor (chain line in FIG. 5) capable of securing satisfactory operability in the conventional hydraulic shovel by the hydraulic solo driving and the characteristics of the regulator 64 have been prestored in a memory.

First, the controller 51 calculates the swinging hydraulic torque Tid1 (in the case where the swing directional control valve has the opening areas capable of securing satisfactory operability by the hydraulic solo driving) by the procedure explained in the above steps (a)-(c) (step S100).

In the above step (a), the controller 51 converts the detection signal inputted from the pressure sensor 53*a* or 53*b* detecting the operating signal (operation command pressure) from the operating device 52 (hereinafter referred to also as the "operating signal" for convenience) into the spool stroke of the swing directional control valve 37 and calculates the opening area Aat0 of the meter-out restrictor at that time by referring to the characteristic of the opening area Aat0 of the meter-out restrictor (broken line in FIG. 4) stored in the memory by use of the spool stroke. Further, the controller 51 receives information on the revolution speed of the swing hydraulic motor 27 from the swing electric motor 25 and calculates the flow rate Q3 using the displacement volume of the swing hydraulic motor 27 (already-known value) and the revolution speed of the swing hydraulic motor 27. Thereafter, the controller 51 calculates the differential pressure ΔPat across the meter-out restrictor (opening area: Δat0) using the orifice equation (1) and then derives the meter-out pressure Pmo0.

In the step (b), the controller 51 determines the discharge flow rate Q1 of the hydraulic pump 41 from the operating signal inputted from the operating device 52 and the characteristics of the regulator 64 of the hydraulic pump 41 stored in the memory and then determines the flow rate Q2 through the bleed-off restrictor using the above expression (2). Further, the controller 51 calculates the bleed-off opening area Apt0 at that time by referring to the characteristic of the bleed-off opening area Apt0 (broken line in FIG. 5) stored in the memory by use of the spool stroke of the swing directional control valve 37 determined from the operating signal from the operating device 52, calculates the differential pressure ΔPpt across the bleed-off restrictor (opening area: Apt0) from the orifice equation (1), and determines the pump discharge pressure P1. Furthermore, the controller 51 calculates the opening area Apc of the meter-in restrictor at that time by referring to the characteristic of the opening area Apc of the meter-in restrictor (chain line in FIG. 5) stored in the memory by use of the spool stroke of the swing directional control valve 37 determined from the operating signal from the operating device 52 and then calculates the meter-in pressure Pmi0 from the orifice equation (1).

In the next step (c), the controller 51 calculates the swinging hydraulic torque Tid1 using the expression (3).

Subsequently, as explained in the above step (d), the controller 51 calculates the swinging hydraulic torque Tre1 of the swing hydraulic system in this embodiment by using the actually measured meter-in pressure Pmi and meter-out pressure Pmo (step S110). In this step, the controller 51 acquires information on the actual measurement values of the meter-in pressure Pmi and the meter-out pressure Pmo from the pressure sensors 63*a* and 63*b* and calculates the swinging hydraulic torque Tre1 using the information.

Subsequently, as explained in the above step (e), the controller 51 calculates the difference ΔT=Tid1−Tre1 between the swinging hydraulic torque Tid1 and the swinging hydraulic torque Tre1 (step S120) and controls the output torque of the swing electric motor 25 so as to achieve the torque deviation (difference) ΔT (step S130).

In the above example, the opening area characteristics with respect to the spool stroke (shown in FIGS. 4 and 5) are stored in the memory of the controller 51 and the opening area Aat0 of the meter-out restrictor, the bleed-off opening area Apt0 and the opening area Apc of the meter-in restrictor are calculated using the opening area characteristics. However, it is also possible to store opening area characteristics with respect to the lever operation amount (operating signal) in the memory (as indicated by the parenthesized captions on the horizontal axes of FIGS. 4 and 5) and calculate the opening area Aat0 of the meter-out restrictor, the bleed-off opening area Apt0 and the opening area Apc of the meter-in restrictor directly from the operating signal from the operating device 52. The operating signal and the lever operation amount, which are substantially in a linear (proportional) relationship, can be regarded as equivalent to each other.

Further, the control of the output torque of the swing electric motor 25 may also be executed in a simpler manner. For example, it is possible to preset the output torque (braking torque, acceleration torque) of the swing electric motor 25 to the controller 51 as a function of the operation command pressure (operating signal) outputted by the operating device 52, determine target torque by referring to the function using the operation command pressure at that time, and control the swing electric motor 25 so as to achieve the target torque. In this case, the function regarding the operation command pressure (operating signal) and the output torque of the swing electric motor 25 is desired to be set so that the total sum of output torque occurring in the swing hydraulic motor 27 and the output torque of the swing electric motor 25 equals output torque of the swing hydraulic motor of the conventional construction machine (hydraulic shovel) (driving the upper swing structure 20 with the swing hydraulic motor 27 alone) in typical swinging operations of the hydraulic shovel.

<Time-Line Waveforms of Control>

Figure 8:
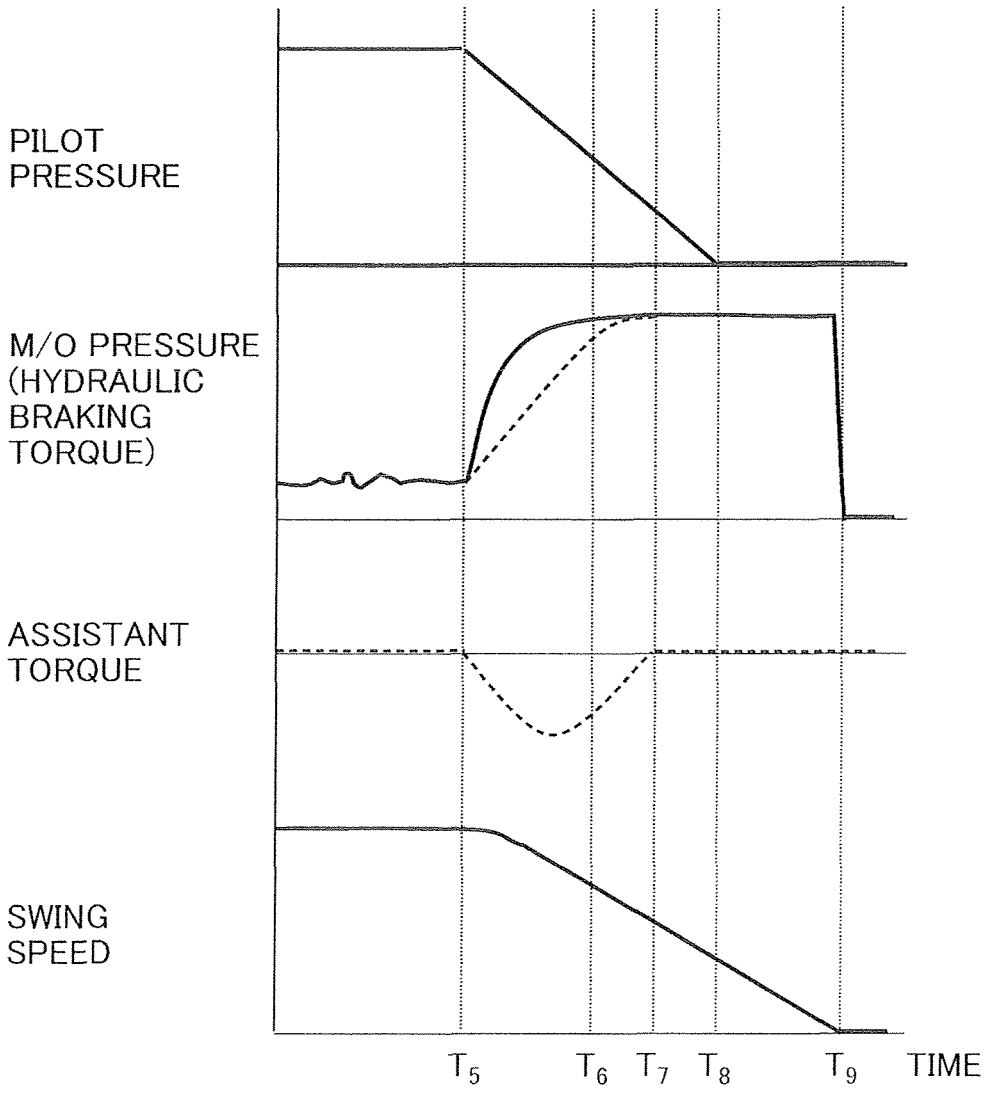
FIG. 8 is a graph showing time-line waveforms of electric motor control in the braking of the swinging in a case where operation command pressure (hydraulic pilot signal) from an operating device (initially at the maximum level corresponding to the maximum swinging speed) is reduced with time in a ramp-like shape down to 0.
Figure 9:
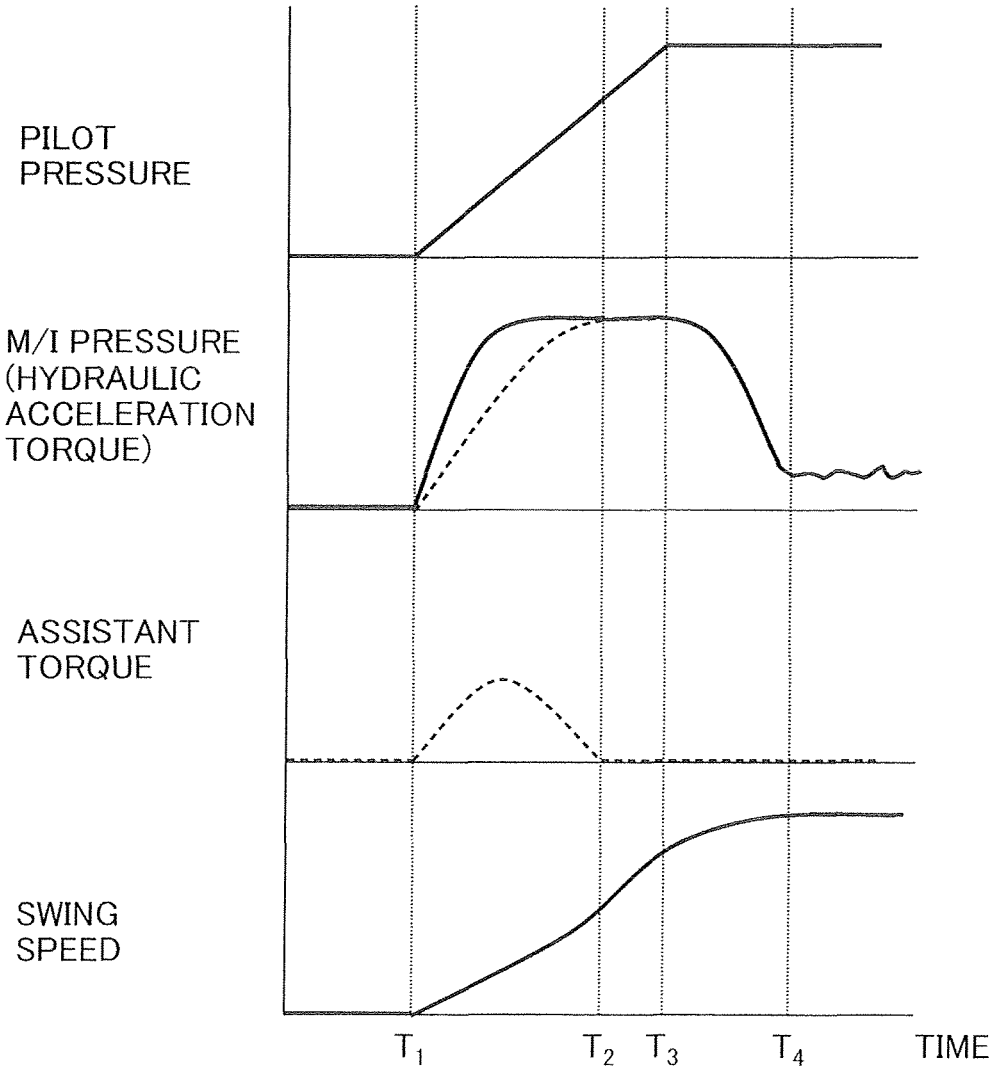
FIG. 9 is a graph showing time-line waveforms of the electric motor control in the acceleration of the swinging in a case where the operation command pressure (hydraulic pilot signal) from the operating device (initially at 0 corresponding to the swinging-stopped state) is increased with time in a ramp-like shape up to the maximum level.

Time-line waveforms in a case where the swing electric motor 25 is controlled by operating the swinging operating device 52 are shown in FIGS. 8 and 9. FIG. 8 shows time-line waveforms of the electric motor control in the braking of the swinging in a case where the operation command pressure from the operating device 52 (initially at the maximum level corresponding to the maximum swinging speed) is reduced with time (T=T5–T8) gradually (in a ramp-like shape) down to 0. FIG. 9 shows time-line waveforms of the electric motor control in the acceleration of the swinging in a case where the operation command pressure from the operating device 52 (initially at 0 corresponding to the swinging-stopped state) is increased with time (T=T1–T3) gradually (in a ramp-like shape) up to the maximum level.

Referring to FIG. 8, in the case where the operation command pressure from the operating device 52 (initially at the maximum level corresponding to the maximum swinging speed) is reduced with time (T=T5–T8) in a ramp-like shape down to 0, the meter-out pressure (M/O pressure) of the swing hydraulic motor 27 in this embodiment (broken line) becomes lower than that in the conventional hydraulic shovel since the meter-out restrictor (37MOa, 37MOc) of the swing directional control valve 37 is designed to have an opening area larger than that in the conventional hydraulic shovel. Since the difference in the meter-out pressure directly corresponds to the difference in the braking torque, the torque of the swing hydraulic motor 27 (hydraulic motor torque) in this embodiment becomes lower in the absolute value than that in the case of employing the opening area capable of securing satisfactory operability in the conventional hydraulic shovel by the hydraulic solo driving. Thus, braking torque corresponding to the difference in the hydraulic motor torque has to be provided by the swing electric motor 25. In FIG. 8, the negative assistant torque means assistant torque on the regeneration side. Since the total sum of the assistant torque of the swing electric motor 25 and the braking torque deriving from the meter-out pressure caused by the swing directional control valve 37 is controlled in this embodiment to be substantially equal to the braking torque occurring in the conventional hydraulic shovel as explained above, the swinging speed of the upper swing structure 20 is allowed to give a deceleration feeling equivalent to that in the conventional hydraulic shovel.

Referring to FIG. 9, in the case where the operation command pressure from the operating device 52 (initially at 0 corresponding to the swinging-stopped state) is increased with time (T=T1–T3) in a ramp-like shape up to the maximum level, the meter-in pressure (M/I pressure) of the swing hydraulic motor 27 in this embodiment (broken line) becomes lower than that in the conventional hydraulic shovel since the bleed-off restrictor 37BO of the swing directional control valve 37 is designed to have an opening area larger than that in the conventional hydraulic shovel. Since the difference in the meter-in pressure directly corresponds to the difference in the acceleration torque, the torque of the swing hydraulic motor 27 (hydraulic motor torque) in this embodiment becomes lower in the absolute value than that in the case of employing the opening area capable of securing satisfactory operability in the conventional hydraulic shovel by the hydraulic solo driving. Thus, acceleration torque corresponding to the difference in the hydraulic motor torque has to be provided by the swing electric motor 25. In FIG. 9, the positive assistant torque means assistant torque on the power running side. Since the total sum of the assistant torque of the swing electric motor 25 and the acceleration torque deriving from the meter-in pressure caused by the swing directional control valve 37 is controlled in this embodiment to be substantially equal to the acceleration torque occurring in the conventional hydraulic shovel as explained above, the swinging speed of the upper swing structure 20 is allowed to give an acceleration feeling equivalent to that in the conventional hydraulic shovel.

<Advantages>

According to this embodiment configured as above, the upper swing structure 20 is driven by using the swing hydraulic motor 27 and the swing electric motor 25 together. Therefore, the energy of the upper swing structure 20 in deceleration or stopping can be regenerated by the swing electric motor 25 into electric power and the regenerated electric power can be used by the swing electric motor 25 for assisting the swing hydraulic motor 27 driving the upper swing structure 20.

Further, the opening area characteristics of the meter-out restrictor and the bleed-off restrictor of the swing directional control valve 37 are set so that the opening areas of the meter-out restrictor and the bleed-off restrictor become larger than the prescribed opening areas set to the construction machines driving the upper swing structure 20 with the swing hydraulic motor 27 alone. The torque of the swing electric motor 25 is controlled so that the total sum of the actual braking torque occurring in the swing hydraulic motor 27 and the braking torque of the swing electric motor 25 in the deceleration of the swing hydraulic motor 27 equals the braking torque occurring when the aforementioned prescribed opening areas are employed and the total sum of the actual acceleration torque occurring in the swing hydraulic motor 27 and the acceleration torque of the swing electric motor 25 in the acceleration of the swing hydraulic motor 27 equals the acceleration torque occurring when the aforementioned prescribed opening areas are employed. Therefore, the braking torque in the deceleration of the swinging of the upper swing structure 20 and the acceleration torque in the acceleration of the swinging of the upper swing structure 20 become equivalent to the braking torque and the acceleration torque in the conventional construction machines (driving the upper swing structure 20 with the hydraulic motor alone), respectively.

Consequently, a satisfactory operational feeling equivalent to that in the construction machines driving the upper swing structure 20 with the hydraulic motor alone can be secured in the deceleration and acceleration of the swinging of the upper swing structure 20.

Furthermore, since the opening area characteristics of the meter-out restrictor and the bleed-off restrictor of the directional control valve 37 with respect to the stroke of the swing directional control valve 37 are set so that the opening areas of the meter-out restrictor and the bleed-off restrictor become larger than the aforementioned prescribed opening areas, just supplying the operating signal of the operating device 52 directly to the swing directional control valve 37 as shown in FIG. 3 makes the opening area of the meter-out restrictor of the swing directional control valve 37 larger than the aforementioned prescribed opening area. Therefore, an operation system including the conventional operating device can be employed without modification as the operation system including the operating device 52. Consequently, the operation system can be configured and implemented at a low cost.

<Modification>

Figure 10:
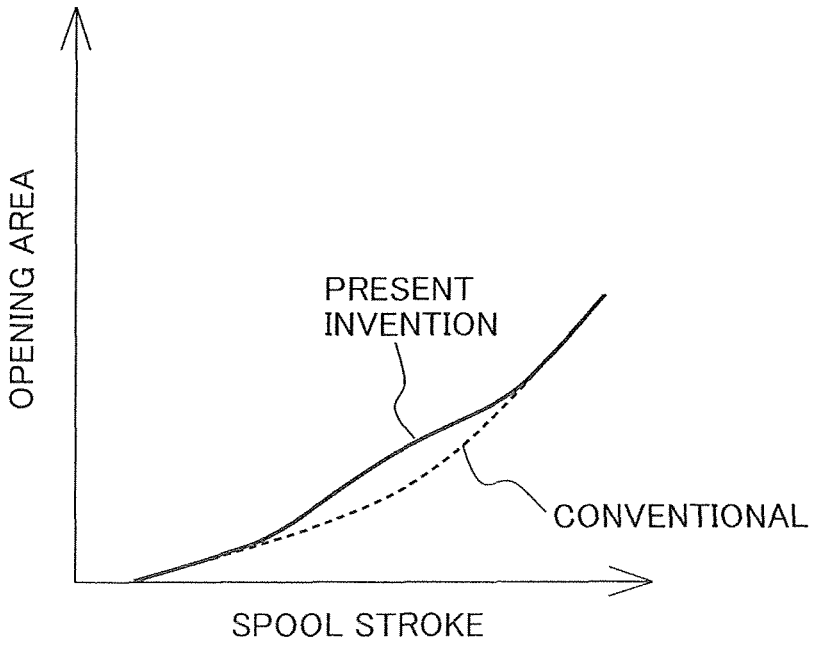
FIG. 10 is a graph showing another example of the opening area characteristic of the meter-out restrictor of the swing directional control valve with respect to the spool stroke.
Figure 11:
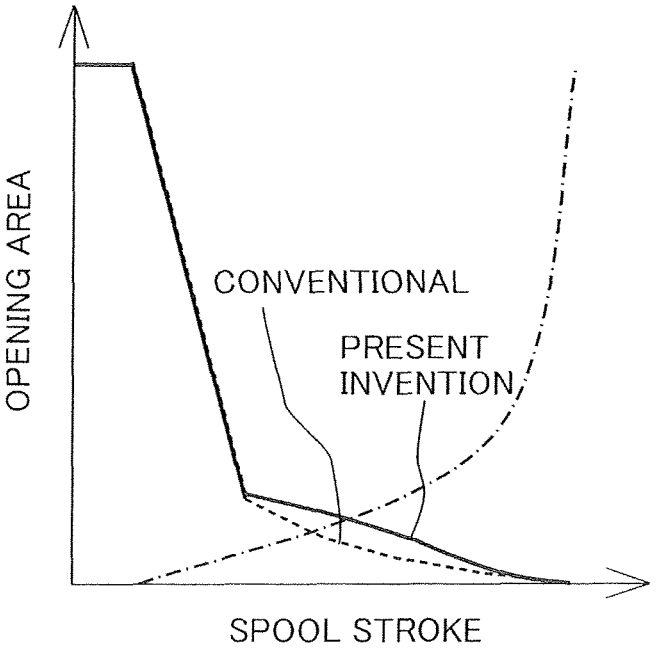
FIG. 11 is a graph showing another example of the opening area characteristics of the meter-in restrictor and the bleed-off restrictor of the swing directional control valve with respect to the spool stroke.

The opening area characteristics of the meter-out restrictor and the bleed-off restrictor in the present invention are not restricted to those shown in FIGS. 4 and 5. Opening area characteristics that deviate from the conventional characteristics in intermediate zones only (see FIGS. 10 and 11) may also be employed. Even with such a deformation, the aforementioned advantages of the present invention can be achieved similarly. In other words, the opening areas of the meter-out restrictor and the bleed-off restrictor may be set freely within the extent not departing from the spirit and scope of the present invention.

Second Embodiment

A hybrid hydraulic shovel in accordance with a second embodiment of the present invention will be described below with reference to FIGS. 12-19.

<System Configuration>

Figure 12:
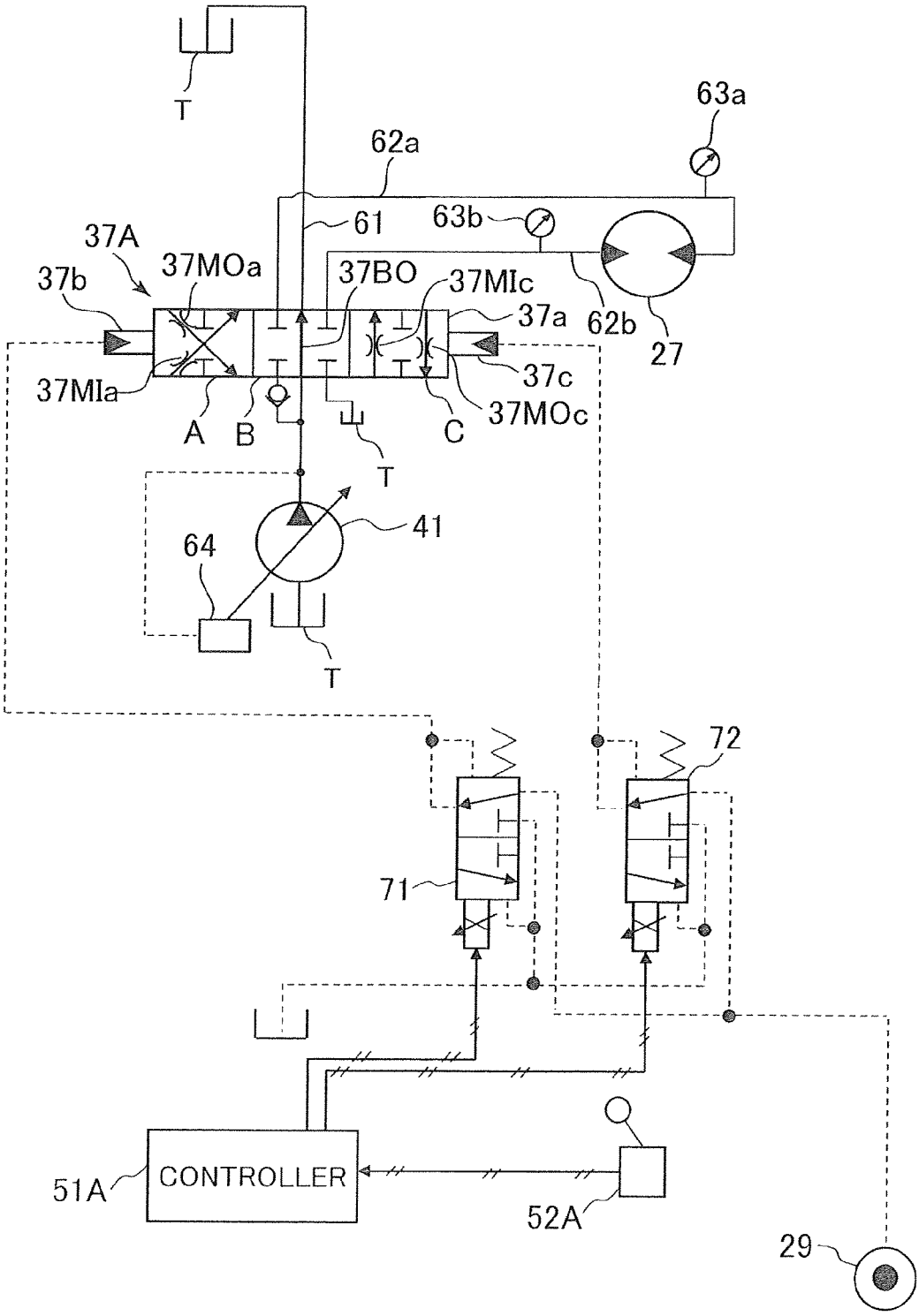
FIG. 12 is a schematic diagram (similar to FIG. 3) showing the details of the swing hydraulic system (part of the hydraulic circuit system related to the swing section) mounted on a hybrid hydraulic shovel in accordance with a second embodiment of the present invention.

FIG. 12 is a schematic diagram (similar to FIG. 3) showing the details of the swing hydraulic system (part of the hydraulic circuit system related to the swing section) mounted on the hybrid hydraulic shovel of this embodiment, wherein components identical with those in FIG. 1-FIG. 3 are assigned the same reference characters as in FIG. 1-FIG. 3.

Referring to FIG. 12, the swing hydraulic system in this embodiment includes solenoid-operated proportional pressure-reducing valves 71 and 72 for generating swinging operation command pressures to be supplied to pressure chambers 37*b* and 37*c* of a swing directional control valve 37A. A swinging operating device 52A (hereinafter referred to simply as an "operating device 52A") is a lever-operated operating device which outputs an electric signal as the operating signal. A controller 51A receives the operating signal (electric signal) from the lever-operated operating device 52A and outputs corresponding control signals (electric signals) to the solenoid-operated proportional pressure-reducing valves 71 and 72.

<Opening Area Characteristic>

Figure 13:
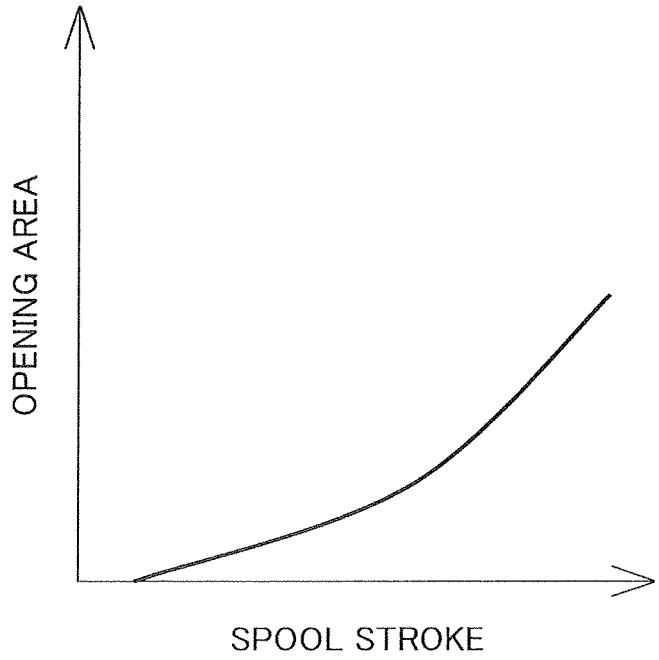
FIG. 13 is a graph showing the opening area characteristic of the meter-out restrictor of a swing directional control valve in the second embodiment with respect to the spool stroke.
Figure 14:
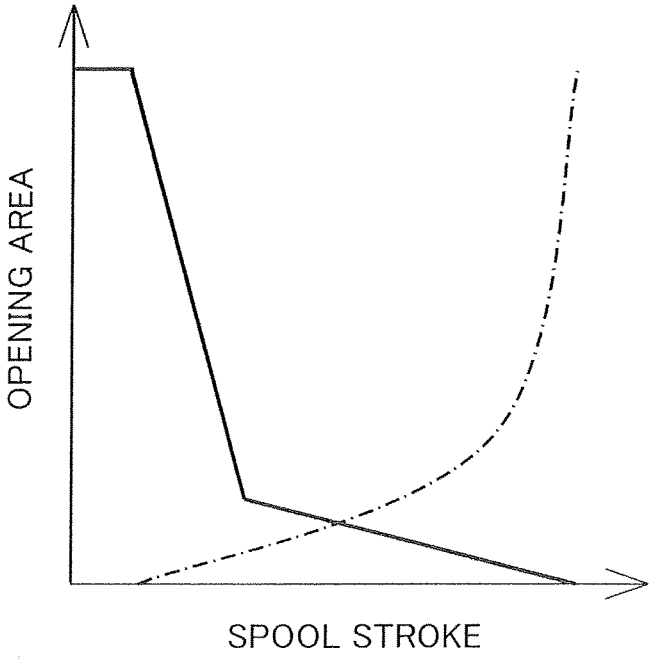
FIG. 14 is a graph showing the opening area characteristics of the meter-in restrictor and the bleed-off restrictor of the swing directional control valve in the second embodiment with respect to the spool stroke.

FIG. 13 shows the opening area characteristic of the meter-out restrictor of the swing directional control valve 37A with respect to the spool stroke. FIG. 14 shows the opening area characteristics of the meter-in restrictor and the bleed-off restrictor of the swing directional control valve 37A with respect to the spool stroke.

In this embodiment, a swing directional control valve having opening areas capable of securing satisfactory operability in the conventional hydraulic shovel by the hydraulic solo driving is used as the swing directional control valve 37A. Consequently, the opening area characteristic of the meter-out restrictor (37MOa, 37MOc) of the swing directional control valve 37A is identical with that indicated by the broken line in FIG. 4 (opening area characteristic of the meter-out restrictor of the swing directional control valve capable of securing satisfactory operability in the conventional hydraulic shovel by the hydraulic solo driving) and the opening area characteristic of the bleed-off restrictor 37BO of the swing directional control valve 37A is identical with that indicated by the broken line in FIG. 5 (opening area characteristic of the bleed-off restrictor of the swing directional control valve capable of securing satisfactory operability in the conventional hydraulic shovel by the hydraulic solo driving). In other words, the opening area characteristic of the meter-out restrictor (37MOa, 37MOc) of the swing directional control valve 37A is set so that the opening area of the meter-out restrictor equals the aforementioned prescribed opening area set to the construction machines driving the upper swing structure 20 with the swing hydraulic motor 27 alone (broken line in FIG. 4) and the opening area characteristic of the bleed-off restrictor 37BO of the swing directional control valve 37A is set so that the opening area of the bleed-off restrictor equals the aforementioned prescribed opening area set to the construction machines driving the upper swing structure 20 with the swing hydraulic motor 27 alone (broken line in FIG. 5). The opening area characteristic of the meter-in restrictor in this embodiment is set to be identical with that in the conventional construction machines (hydraulic shovels) similarly to the first embodiment.

<Outline of Control>

Next, the control executed by the controller 51A will be described below.

The controller 51A executes torque control of the swing electric motor 25 similarly to the first embodiment. Further, the controller 51A executes control so that the opening area characteristics of the swing directional control valve 37A with respect to the lever operation amount of the operating device 52A become substantially identical with the opening area characteristics of the meter-out restrictor (37MOa, 37MOc) and the bleed-off restrictor 37BO of the swing directional control valve 37 in the first embodiment with respect to the lever operation amount of the operating device 52. In other words, when the opening area characteristics of the swing directional control valve 37A are considered in terms of opening area characteristics with respect to the lever operation amount of the operating device 52A, the controller 51A corrects the operating signal from the operating device 52A so that the opening areas of the meter-out restrictor (37MOa, 37MOc) and the bleed-off restrictor 37BO become larger than the opening areas of the meter-out restrictor and the bleed-off restrictor of the swing directional control valve capable of securing satisfactory operability in the conventional hydraulic shovel by the hydraulic solo driving (i.e., the prescribed opening areas set to the construction machines driving the upper swing structure 20 with the swing hydraulic motor 27 alone).

<Processing Functions of Controller>

Figure 15:
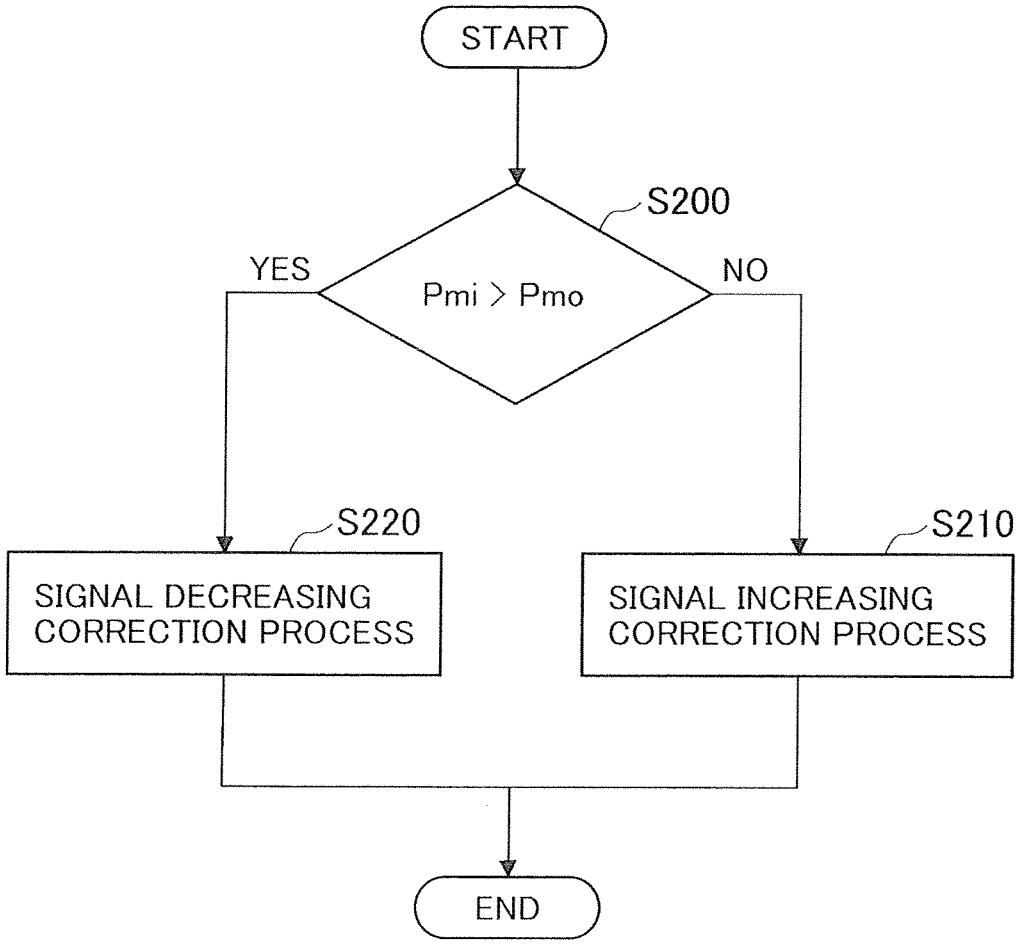
FIG. 15 is a flow chart showing the details of processing functions of a controller in the second embodiment for the swing directional control valve.

FIG. 15 is a flow chart showing the details of processing functions of the controller 51A for the swing directional control valve 37A.

The controller 51A acquires information on the actual measurement values of the meter-in pressure Pmi and the meter-out pressure Pmo from the pressure sensors 63*a* and 63*b* and judges whether the meter-in pressure Pmi is higher than the meter-out pressure Pmo (step S200). When the meter-in pressure Pmi is higher than the meter-out pressure Pmo, the swing hydraulic motor 27 is in acceleration (driving), otherwise the swing hydraulic motor 27 is in braking (deceleration). In the case where the meter-in pressure Pmi is higher than the meter-out pressure Pmo (in the acceleration of the swing hydraulic motor 27), the controller 51A executes signal decreasing correction control to the operating signal inputted from the operating device 52A (step S220), otherwise (in the braking of the swing hydraulic motor 27) the controller 51A executes signal increasing correction control to the operating signal inputted from the operating device 52A (step S210).

Figure 16:
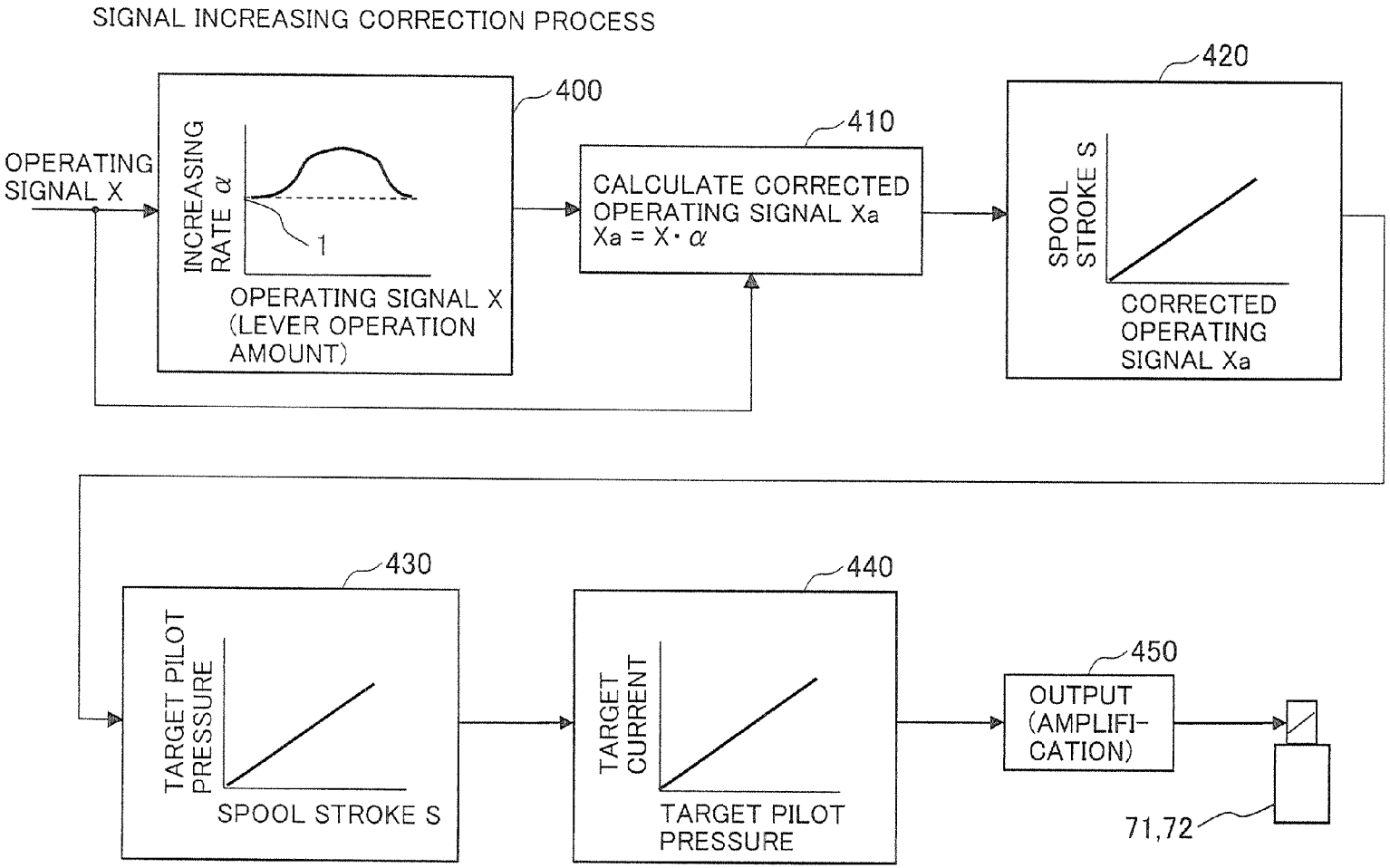
FIG. 16 is a functional block diagram showing the details of a signal increasing correction process executed in step S210 in FIG. 15.

FIG. 16 is a functional block diagram showing the details of the signal increasing correction control executed in the step S210. For the signal increasing correction control function, the controller 51A includes an increasing rate calculation unit 400, a corrected operating signal calculation unit 410, a spool stroke calculation unit 420, a target pilot pressure calculation unit 430, a target current calculation unit 440 and an output unit 450.

The increasing rate calculation unit 400 receives the operating signal X from the operating device 52A and calculates an increasing rate $\alpha$ (numerical value≥1) for the increasing correction control of the operating signal X by referring to a table that specifies a preset functional relationship between the operating signal X and the increasing rate $\alpha$. The functional relationship between the operating signal X and the increasing rate $\alpha$ has been set so that the opening area characteristic of the meter-out restrictor (37MOa, 37MOc) of the swing directional control valve 37A with respect to the lever operation amount of the operating device 52A becomes substantially identical with the opening area characteristic of the meter-out restrictor (37MOa, 37MOc) of the swing directional control valve 37 in the first embodiment with respect to the lever operation amount of the operating device 52. In other words, when the opening area characteristics of the swing directional control valve 37A are considered in terms of opening area characteristics with respect to the lever operation amount of the operating device 52A, the functional relationship has been set so that the opening area of the meter-out restrictor (37MOa, 37MOc) becomes larger than that of the meter-out restrictor of the swing directional control valve capable of securing satisfactory operability in the conventional hydraulic shovel by the hydraulic solo driving.

The corrected operating signal calculation unit 410 calculates a corrected operating signal Xa by multiplying the operating signal X from the operating device 52A by the increasing rate $\alpha$.

The spool stroke calculation unit 420 converts the corrected operating signal Xa calculated by the corrected operating signal calculation unit 410 into a spool stroke S. The target pilot pressure calculation unit 430 converts the spool stroke S into a target pilot pressure. The target current calculation unit 440 converts the target pilot pressure into a target current for driving the solenoid-operated proportional pressure-reducing valve 71 or 72. The output unit 450 amplifies the target current and outputs the amplified target current to the solenoid-operated proportional pressure-reducing valve 71 or 72. The processes executed by the components from the spool stroke calculation unit 420 are identical with processes executed by a controller of a conventional system equipped with an operating device outputting an electric signal.

Figure 17:
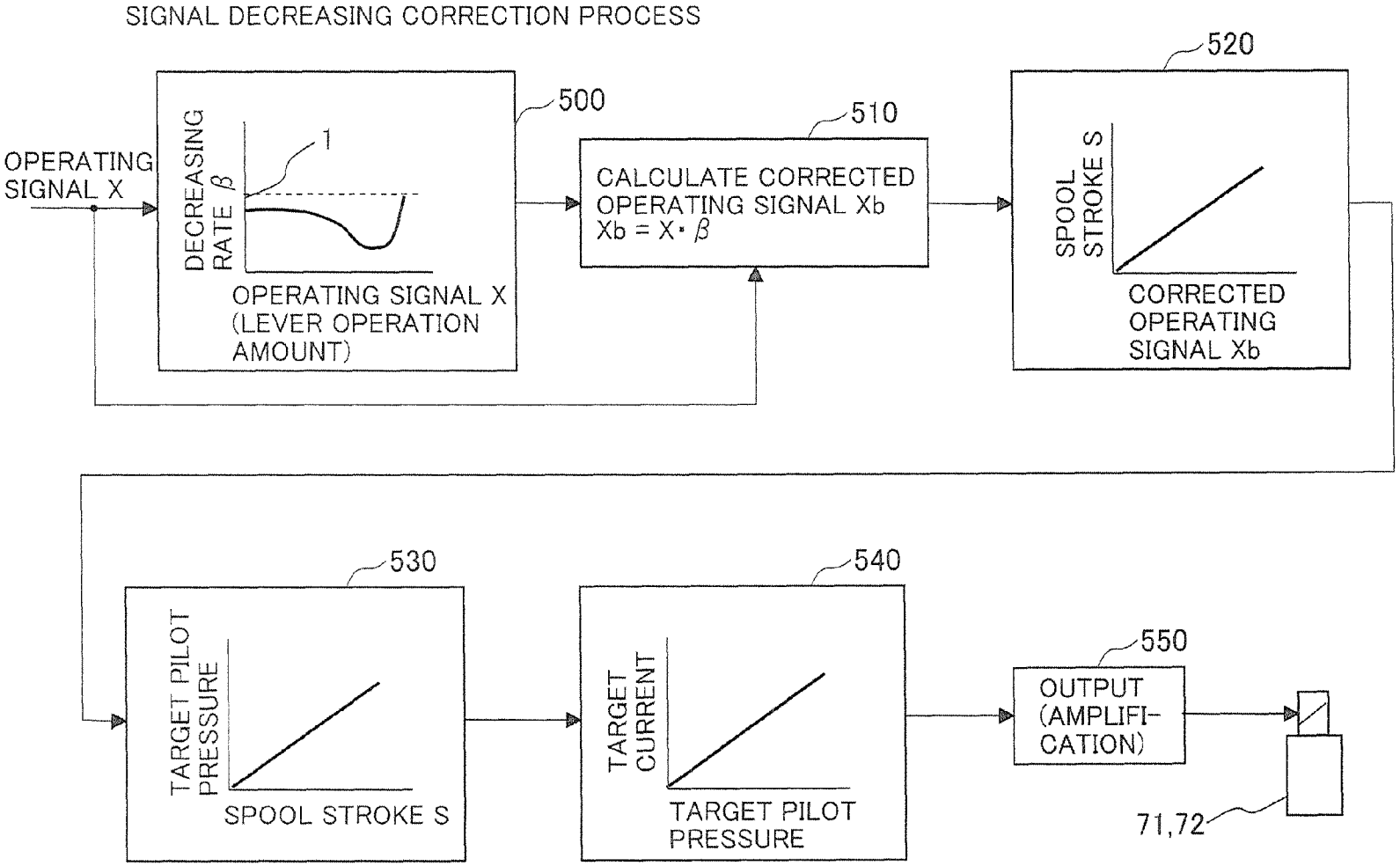
FIG. 17 is a functional block diagram showing the details of a signal decreasing correction process executed in step S220 in FIG. 15.

FIG. 17 is a functional block diagram showing the details of the signal decreasing correction control executed in the step S220. For the signal decreasing correction control function, the controller 51A includes a decreasing rate calculation unit 500, a corrected operating signal calculation unit 510, a spool stroke calculation unit 520, a target pilot pressure calculation unit 530, a target current calculation unit 540 and an output unit 550.

The decreasing rate calculation unit 500 receives the operating signal X from the operating device 52A and calculates a decreasing rate $\beta$ (numerical value≤1) for the decreasing correction control of the operating signal X by referring to a table that specifies a preset functional relationship between the operating signal X and the decreasing rate $\beta$. The functional relationship between the operating signal X and the decreasing rate $\beta$ has been set so that the opening area characteristic of the bleed-off restrictor 37BO of the swing directional control valve 37A with respect to the lever operation amount of the operating device 52A becomes substantially identical with the opening area characteristic of the bleed-off restrictor 37BO of the swing directional control valve 37 in the first embodiment with respect to the lever operation amount of the operating device 52. In other words, when the opening area characteristics of the swing directional control valve 37A are considered in terms of opening area characteristics with respect to the lever operation amount of the operating device 52A, the functional relationship has been set so that the opening area of the bleed-off restrictor 37BO becomes larger than that of the bleed-off restrictor of the swing directional control valve capable of securing satisfactory operability in the conventional hydraulic shovel by the hydraulic solo driving.

The corrected operating signal calculation unit 510 calculates a corrected operating signal Xb by multiplying the operating signal X from the operating device 52A by the decreasing rate $\beta$.

The spool stroke calculation unit 520 converts the corrected operating signal Xb calculated by the corrected operating signal calculation unit 510 into a spool stroke S. The target pilot pressure calculation unit 530 converts the spool stroke S into a target pilot pressure. The target current calculation unit 540 converts the target pilot pressure into a target current for driving the solenoid-operated proportional pressure-reducing valve 71 or 72. The output unit 550 amplifies the target current and outputs the amplified target current to the solenoid-operated proportional pressure-reducing valve 71 or 72. The processes executed by the components from the spool stroke calculation unit 520 are identical with processes executed by a controller of a conventional system equipped with an operating device outputting an electric signal.

Figure 18:
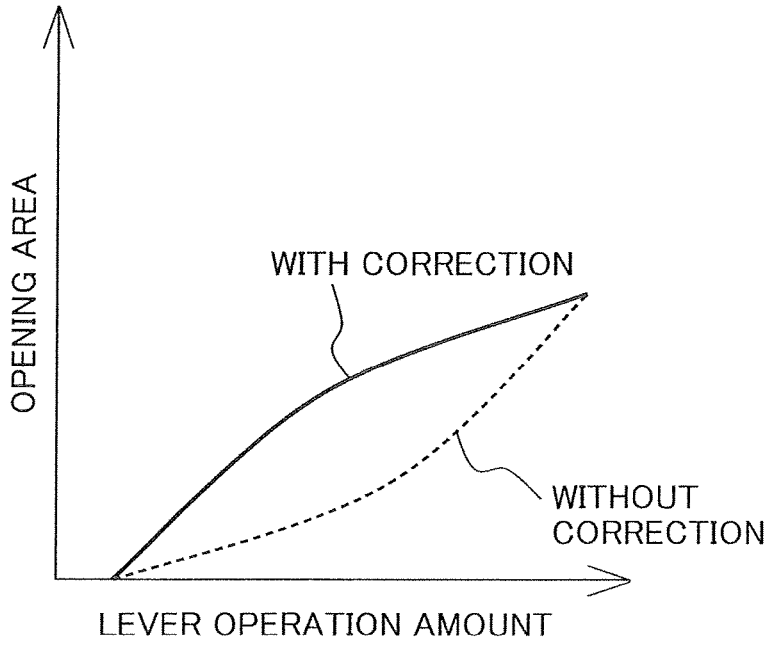
FIG. 18 is a graph showing the relationship between a lever operation amount and the opening area of the meter-out restrictor of the swing directional control valve when the increasing correction process is executed to an operating signal from the operating device.
Figure 19:
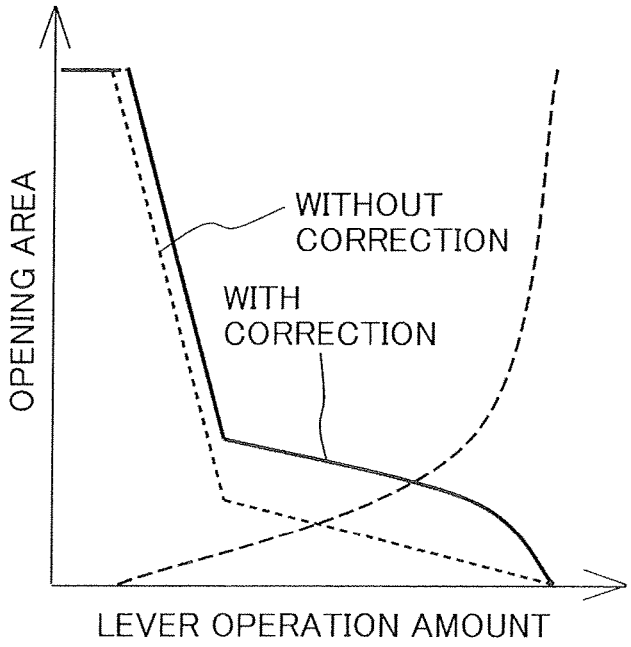
FIG. 19 is a graph showing the relationship between the lever operation amount and the opening area of the bleed-off restrictor of the swing directional control valve when the decreasing correction process is executed to the operating signal from the operating device.

FIGS. 18 and 19 are graphs showing the relationship between the lever operation amount and the opening areas of the meter-out restrictor (37MOa, 37MOc) and the bleed-off restrictor 37BO of the swing directional control valve 37A when the increasing/decreasing correction control is executed to the operating signal from the operating device 52A as explained above. In FIGS. 18 and 19, solid lines indicate the opening areas when the increasing/decreasing correction control is executed to the operating signal and broken lines indicate the opening areas when the increasing/decreasing correction control is not executed to the operating signal. As is clear from FIGS. 18 and 19, the operating signal is corrected so that the opening area characteristics of the meter-out restrictor (37MOa, 37MOc) (FIG. 18) and the bleed-off restrictor 37BO (FIG. 19) of the swing directional control valve 37A with respect to the lever operation amount of the operating device 52A become substantially identical with the opening area characteristics of the meter-out restrictor (37MOa, 37MOc) and the bleed-off restrictor 37BO of the swing directional control valve 37 in the first embodiment with respect to the lever operation amount of the operating device 52. In other words, when the opening area characteristics of the swing directional control valve 37A are considered in terms of opening area characteristics with respect to the lever operation amount of the operating device 52A, the operating signal is corrected so that the opening areas of the meter-out restrictor (37MOa, 37MOc) and the bleed-off restrictor 37BO become larger than those of the meter-out restrictor and the bleed-off restrictor of the swing directional control valve capable of securing satisfactory operability in the conventional hydraulic shovel by the hydraulic solo driving.

Therefore, also by this embodiment (similarly to the first embodiment), the energy of the upper swing structure 20 in deceleration or stopping can be regenerated by the swing electric motor 25 into electric power and the regenerated electric power can be used by the swing electric motor 25 for assisting the swing hydraulic motor 27 driving the upper swing structure 20, while also securing a satisfactory operational feeling equivalent to that in the construction machines driving the upper swing structure 20 with the hydraulic motor alone.

Further, according to this embodiment, even when the directional control valve 37A is identical with the directional control valve in the construction machines driving the upper swing structure 20 with the swing hydraulic motor 27 alone, the operating signal is corrected so that the opening areas of the meter-out restrictor and the bleed-off restrictor of the directional control valve 37 become larger than the prescribed opening areas of the swing directional control valve in the conventional construction machines (driving the upper swing structure 20 with the swing hydraulic motor 27 alone) in the opening area characteristics with respect to the operating signal. Therefore, the conventional directional control valve can directly be employed as the directional control valve 37A. Consequently, the directional control valve 37A can be configured and implemented at a low cost.

What is claimed is:

1. A hybrid construction machine comprising:

a lower travel structure;

an upper swing structure which is mounted on the lower travel structure to be capable of swinging;

a hydraulic circuit system which includes a swing hydraulic motor for driving and swinging the upper swing structure, a hydraulic pump supplying hydraulic fluid to the swing hydraulic motor, a tank receiving the hydraulic fluid returning from the swing hydraulic motor and serving as the source of supply of the hydraulic fluid to the hydraulic pump, and a directional control valve arranged in a line connecting the hydraulic pump and the swing hydraulic motor and controlling the direction and the flow rate of the hydraulic fluid discharged from the hydraulic pump and supplied to the swing hydraulic motor;

a prime mover which drives the hydraulic pump;

a swing electric motor which drives and swings the upper swing structure in an auxiliary manner, the swing electric motor functioning as an electric generator when the swinging of the upper swing structure is decelerating;

an electricity storage device which receives and supplies electric energy from/to the swing electric motor; and a control device which controls the operation of the swing electric motor, wherein:

the directional control valve includes a meter-in restrictor placed between the hydraulic pump and the swing hydraulic motor and a meter-out restrictor placed between the swing hydraulic motor and the tank, and an opening area characteristic of the meter-out restrictor is set so that the opening area of the meter-out restrictor becomes larger than a prescribed opening area that is set to construction machines driving the upper swing structure with the swing hydraulic motor alone, and the control device controls torque of the swing electric motor so that the total sum of actual braking torque occurring in the swing hydraulic motor and braking torque of the swing electric motor in deceleration of the swing hydraulic motor equals braking torque occurring when the opening area of the meter-out restrictor is set at the prescribed opening area.

2. The hybrid construction machine according to claim 1, wherein the opening area characteristic of the meter-out restrictor of the directional control valve is set so that the opening area of the meter-out restrictor considered in terms of an opening area characteristic with respect to the stroke of the directional control valve becomes larger than the prescribed opening area.

3. The hybrid construction machine according to claim 1, wherein:

the opening area characteristic of the meter-out restrictor of the directional control valve is set so that the opening area of the meter-out restrictor considered in terms of an opening area characteristic with respect to the stroke of the directional control valve equals the prescribed opening area, and the hybrid construction machine further comprises an operating device which outputs an operating signal for driving the directional control valve, and the control device corrects the operating signal so that the opening area of the meter-out restrictor considered in terms of an opening area characteristic of the directional control valve with respect to the operating signal becomes larger than the prescribed opening area.

4. The hybrid construction machine according to claim 1, wherein the directional control valve further includes a bleed-off restrictor placed between the hydraulic pump and the tank, and an opening area characteristic of the bleed-off restrictor is set so that the opening area of the bleed-off restrictor becomes larger than a prescribed opening area that is set to the construction machines driving the upper swing structure with the swing hydraulic motor alone, and the control device controls the torque of the swing electric motor so that the total sum of actual acceleration torque occurring in the swing hydraulic motor and acceleration torque of the swing electric motor in acceleration of the swing hydraulic motor equals acceleration torque occurring when the opening area of the bleed-off restrictor is set at the prescribed opening area.

5. The hybrid construction machine according to claim 4, wherein the opening area characteristic of the bleed-off restrictor of the directional control valve is set so that the opening area of the bleed-off restrictor considered in terms of an opening area characteristic with respect to the stroke of the directional control valve becomes larger than the prescribed opening area.

6. The hybrid construction machine according to claim 4, wherein the opening area characteristic of the bleed-off restrictor of the directional control valve is set so that the opening area of the bleed-off restrictor considered in terms of an opening area characteristic with respect to the stroke of the directional control valve equals the prescribed opening area, and the hybrid construction machine further comprises an operating device which outputs an operating signal for driving the directional control valve, and the control device corrects the operating signal so that the opening area of the bleed-off restrictor considered in terms of an opening area characteristic of the directional control valve with respect to the operating signal becomes larger than the prescribed opening area.

7. A hybrid construction machine comprising:

a lower travel structure;

an upper swing structure which is mounted on the lower travel structure to be capable of swinging;

a swing hydraulic motor which drives and swings the upper swing structure;

a hydraulic pump which supplies hydraulic fluid to the swing hydraulic motor;

a tank which receives the hydraulic fluid returning from the swing hydraulic motor and serves as the source of supply of the hydraulic fluid to the hydraulic pump;

a directional control valve which is arranged in a line connecting the hydraulic pump and the swing hydraulic motor and controls the direction and the flow rate of the hydraulic fluid discharged from the hydraulic pump and supplied to the swing hydraulic motor;

a prime mover which drives the hydraulic pump;

a swing electric motor which drives and swings the upper swing structure in an auxiliary manner, the swing electric motor functioning as an electric generator when the swinging of the upper swing structure is decelerating;

an electricity storage device which receives and supplies electric energy from/to the swing electric motor; and a control device which controls the operation of the swing electric motor, wherein:

the directional control valve includes a bleed-off restrictor placed between the hydraulic pump and the tank, a meter-in restrictor placed between the hydraulic pump and the swing hydraulic motor, and a meter-out restrictor placed between the swing hydraulic motor and the tank, and an opening area characteristic of the bleed-off restrictor is set so that the opening area of the bleed-off restrictor becomes larger than a prescribed opening area that is set to construction machines driving the upper swing structure with the swing hydraulic motor alone, and the control device controls torque of the swing electric motor so that the total sum of actual acceleration torque occurring in the swing hydraulic motor and acceleration torque of the swing electric motor in acceleration of the swing hydraulic motor equals acceleration torque occurring when the opening area of the bleed-off restrictor is set at the prescribed opening area.

8. The hybrid construction machine according to claim 7, wherein the opening area characteristic of the bleed-off restrictor of the directional control valve is set so that the opening area of the bleed-off restrictor considered in terms of an opening area characteristic with respect to the stroke of the directional control valve becomes larger than the prescribed opening area.

9. The hybrid construction machine according to claim 7, wherein the opening area characteristic of the bleed-off restrictor of the directional control valve is set so that the opening area of the bleed-off restrictor considered in terms of an opening area characteristic with respect to the stroke of the directional control valve equals the prescribed opening area, and the hybrid construction machine further comprises an operating device which outputs an operating signal for driving the directional control valve, and the control device corrects the operating signal so that the opening area of the bleed-off restrictor considered in terms of an opening area characteristic of the directional control valve with respect to the operating signal becomes larger than the prescribed opening area.

* * * * *